US009875865B2

(12) United States Patent
Liao et al.

(10) Patent No.: US 9,875,865 B2
(45) Date of Patent: Jan. 23, 2018

(54) HAPTIC KEYSWITCH STRUCTURE AND INPUT DEVICE

(71) Applicants: DARFON ELECTRONICS (SUZHOU) CO., LTD., Suzhou (CN); DARFON ELECTRONICS CORP., Taoyuan County (TW)

(72) Inventors: Rui-Ming Liao, Taoyuan County (TW); Hung-Chieh Lo, Taoyuan County (TW)

(73) Assignees: DARFON ELECTRONICS (SUZHOU) CO., LTD., Suzhou (CN); DARFON ELECTRONICS CORP., Taoyuan County (TW)

( * ) Notice: Subject to any disclaimer, the term of this patent is extended or adjusted under 35 U.S.C. 154(b) by 0 days.

(21) Appl. No.: 15/172,560

(22) Filed: Jun. 3, 2016

(65) Prior Publication Data

US 2016/0358724 A1 Dec. 8, 2016

(30) Foreign Application Priority Data

Jun. 5, 2015 (TW) ..... 104118376 A

(51) Int. Cl.
*H01H 13/14* (2006.01)
*H01H 13/85* (2006.01)

(52) U.S. Cl.
CPC ..... *H01H 13/85* (2013.01); *H01H 2207/00* (2013.01); *H01H 2211/004* (2013.01);
(Continued)

(58) Field of Classification Search
CPC ..... H01H 13/85–2003/008; H03K 2217/96062–17/9645; G06F 3/016; G06F 3/0202–1/1662
(Continued)

(56) References Cited

U.S. PATENT DOCUMENTS 4,071,718 A 1/1978 Harden
7,952,261 B2 5/2011 Lipton et al.
(Continued)

FOREIGN PATENT DOCUMENTS

CN 101174511 A 5/2008
CN 10147791 7/2009
(Continued)

OTHER PUBLICATIONS

Taiwan Office Action dated May 4, 2016 from related Taiwan Patent Application No. 104118372, 10 pages.
(Continued)

*Primary Examiner* — Vanessa Girardi
(74) *Attorney, Agent, or Firm* — Innovation Capital Law Group, LLP; Vic Lin

(57) ABSTRACT

A keyswitch structure includes a keycap layer having a keycap region, a circuit layer disposed under the keycap layer, at least a haptic actuator disposed under the circuit layer and electrically connected to the circuit layer, a cushion layer disposed under the circuit layer and having an accommodation space for accommodating the haptic actuator, a sensing unit disposed under the cushion layer, and a control circuit coupling the sensing unit and the circuit layer, wherein when an external force is applied and delivered through the cushion layer to trigger the sensing unit, the sensing unit outputs a trigger signal, and the control circuit receives the trigger signal and outputs a driving signal to drive the haptic actuator to vibrate.

16 Claims, 15 Drawing Sheets

(52) U.S. Cl.
CPC ... *H01H 2215/05* (2013.01); *H01H 2215/052* (2013.01); *H01H 2221/064* (2013.01); *H01H 2239/03* (2013.01)

(58) Field of Classification Search
USPC ..... 200/521; 341/27; 340/407.2, 384.6
See application file for complete search history.

(56) References Cited

U.S. PATENT DOCUMENTS

| | | | | |
|---|---|---|---|---|
| 8,953,779 | B2 * | 2/2015 | Tuovinen | B06B 1/0215 340/407.1 |
| 9,576,446 | B2 * | 2/2017 | Zellers | G06F 3/016 |
| 2014/0062683 | A1 | 3/2014 | Liu | |
| 2015/0091414 | A1 | 4/2015 | Korhonen et al. | |
| 2015/0205355 | A1 | 7/2015 | Yairi | |

FOREIGN PATENT DOCUMENTS

| | | | |
|---|---|---|---|
| CN | 104396040 | A | 3/2015 |
| CN | 104681334 | A | 6/2015 |
| CN | 104701053 | A | 6/2015 |
| TW | 2007039399 | | 10/2007 |
| TW | 201432765 | | 8/2014 |
| TW | M490647 | | 11/2014 |
| TW | 201503192 | A | 1/2015 |
| TW | 201505060 | | 2/2015 |

OTHER PUBLICATIONS

Office Action dated May 11, 2017 from related U.S. Appl. No. 15/173,156, 17 pages.

* cited by examiner

HAPTIC KEYSWITCH STRUCTURE AND INPUT DEVICE

BACKGROUND OF THE INVENTION

1. Field of the Invention

The invention generally relates to a keyswitch structure. Particularly, the invention relates to a keyswitch structure having haptic feedback and an input device having the keyswitch structure.

2. Description of the Prior Art

As the thinning requirement becomes more and more critical, the height of keyswitch structure is significantly decreased. Accordingly, the mechanical keyswitch is designed to have a shorter keystroke or gradually substituted by the touch type keyswitch. However, the keyswitch with shorter keystroke or the touch type keyswitch cannot provide effective force feedback during operation, and the user generally has difficulty to ensure whether the pressing manipulation is completed or not.

Current keyboard with the force feedback function generally includes a vibrator to transmit the vibratile wave to the corresponding keyswitch. However, the addition of vibrator or the integration of vibrator with the keyswitch complicates the circuit design and the support structure, less favorable to the thinning requirement. Moreover, the portable device, such as flat computer or smart phone, may provide vibration feedback when the user touches the screen to confirm the pressing operation is completed. However, this kind of vibration feedback is achieved by vibrating the portable device itself or the entire surface of the portable device, instead of providing independent and local haptic feedback.

Therefore, how to effectively provide the haptic feedback independently and locally without compromising the thinning requirement is one of the major considerations for keyswitch design.

SUMMARY OF THE INVENTION

In view of the prior arts, it is an object of the invention to provide a keyswitch structure having haptic feedback and an input device having the keyswitch structure to provide independent and local haptic feedback and promote the user's operation experience.

It is another object of the invention to provide a keyswitch structure and an input device having the keyswitch structure that is a multi-layered film structure to effectively reduce the keyswitch size and enhance the applicability.

In an embodiment, the invention provides a keyswitch structure including a keycap layer, a circuit layer, at least one haptic actuator, a cushion layer, and a control circuit. The keycap layer has a keycap region. The circuit layer is disposed under the keycap layer and has at least one first contact and at least one second contact on a bottom surface of the circuit layer; the first contact is electrically isolated from the second contact. The haptic actuator is disposed under the circuit layer and electrically connected to the first contact and the second contact. The cushion layer is disposed under the circuit layer and has an accommodation space for accommodating the haptic actuator. The sensing unit is disposed under the cushion layer. The sensing unit outputs a trigger signal whenever the sensing unit is triggered. The control circuit couples the sensing unit and the circuit layer. The control circuit outputs a driving signal to the haptic actuator whenever the control circuit receives the trigger signal. When an external force is applied and delivered downwardly through the cushion layer to trigger the sensing unit, the sensing unit outputs the trigger signal and the control circuit outputs the driving signal to drive the haptic actuator.

In an embodiment, the cushion layer includes a film portion having an accommodation area and a protrusion portion disposed around the accommodation area. The protrusion portion extends from the film portion toward the circuit layer to define the accommodation space over the accommodation area.

In an embodiment, the accommodation area is a through hole communicating with the accommodation space. The protrusion portion is disposed around the through hole.

In an embodiment, the keyswitch structure further includes a support layer disposed between the circuit layer and the sensing unit. The support layer has an opening, and the protrusion portion protrudes into the opening. When the external force is applied to the keycap region, the external force is delivered downwardly through the protrusion portion to trigger the sensing unit.

In an embodiment, the opening of the support layer has a first top-view contour; the accommodation space of the cushion layer has a second top-view contour; the haptic actuator has a third top-view contour. All of the first, second, and third top-view contours have same shape.

In an embodiment, the circuit layer further has a first circuit path and a second circuit path. The protrusion portion has a U-shaped configuration with an opening. The first circuit path and the second circuit path are electrically connected to the first contact and the second contact through the opening of the U-shaped configuration, respectively.

In an embodiment, the hardness of the support layer is higher than the hardness of the cushion layer, and the thickness of the support layer is larger than the thickness of the haptic actuator, so that the circuit layer and the sensing unit maintain a predetermined distance separated from each other to provide a vibration space for the haptic actuator.

In an embodiment, the predetermined distance makes the haptic actuator be separated from the sensing unit by at least 0.8 mm.

In an embodiment, the cushion layer further has an extension portion extending from the protrusion portion toward the accommodation space. The extension portion has a top surface lower than the top surface of the protrusion portion. The haptic actuator at least partially abuts on the top surface of the extension portion.

In an embodiment, the film portion further has at least one rib disposed in the through hole. The rib has a top surface lower than the top surface of the protrusion portion to divide the accommodation space into a plurality of sub-spaces.

In an embodiment, the at least one haptic actuator includes a plurality of haptic actuators corresponding to the plurality of sub-spaces, respectively. The at least one first contact and the at least one second contact include a plurality of first contacts and a plurality of second contacts corresponding to the plurality of haptic actuators.

In an embodiment, the thickness of the rib is larger than or equal to the thickness of the haptic actuator.

In an embodiment, the cushion layer is made of silicone material having hardness equal to or lower than 70 A.

In an embodiment, the keyswitch structure further includes an adhesive layer disposed on a bottom surface of the keycap layer outside the keycap region. The keycap layer is adhered to the circuit layer by the adhesive layer, and the bottom surface of the keycap region is separated from the circuit layer.

In another embodiment, the invention provides an input device including a keycap layer, a circuit layer, a plurality of haptic actuators, a cushion layer, a sensor layer, and a control circuit. The keycap layer has a plurality of keycap regions. The circuit layer is disposed under the keycap layer and has a plurality of first contacts and a plurality of second contacts on a bottom surface of the circuit layer. The first contacts are electrically isolated from the second contacts. Each of the keycap regions corresponds to at least one of the first contacts and at least one of the second contacts. The plurality of haptic actuators are disposed under the circuit layer. Each of the keycap regions corresponds to at least one of the haptic actuators, and each of the plurality of haptic actuators is electrically connected to one of the first contacts and one of the second contacts corresponding to the same keycap region. The cushion layer is disposed under the circuit layer and has a plurality of accommodation spaces. Each of the plurality of keycap regions corresponds to at least one of the accommodation spaces, and each of the accommodation spaces accommodates at least one of the plurality of haptic actuators. The sensor layer is disposed under the cushion layer and has a plurality of sensing units. Each of the plurality of keycap regions corresponds to at least one of the sensing units, and each of the sensing units can be triggered to output a trigger signal. The control circuit couples the plurality of sensing units and the circuit layer. The control circuit outputs a driving signal to a corresponding one of the haptic actuators whenever the control circuit receives the trigger signal from the corresponding sensing unit. When an external force is applied to one of the keycap regions and delivered downwardly through the cushion layer to trigger one of the sensing units, the triggered sensing unit outputs the trigger signal and the control circuit outputs the driving signal to drive one of the haptic actuators corresponding to the triggered sensing unit.

In an embodiment, the cushion layer includes a film portion having a plurality of accommodation areas and a plurality of protrusion portions correspondingly disposed around the accommodation areas. The protrusion portions extend from the film portion toward the circuit layer to define the accommodation spaces over the accommodation areas.

In an embodiment, the input device further includes a support layer disposed between the circuit layer and the cushion layer. The support layer has a plurality of openings corresponding to the plurality of keycap regions, and the plurality of protrusion portions protrude into the plurality of openings, respectively.

In an embodiment, the plurality of keycap regions includes a larger-sized keycap region and a regular-sized keycap region smaller than the larger-sized keycap region. A first accommodation space of the accommodation spaces corresponds to the larger-sized keycap region and accommodates at least two of the haptic actuators. The film portion corresponding to the larger-sized keycap region further has at least one rib disposed in the corresponding accommodation area. The rib has a top surface lower than the top surface of the protrusion portion to divide the first accommodation space into a plurality of sub-spaces for accommodating the at least two haptic actuators, respectively.

In an embodiment, the circuit layer includes a plurality of first circuit paths and a plurality of second circuit paths. The number of the first circuit paths is the same as the number of the haptic actuators. Each of the first circuit paths has one of the first contacts.

In an embodiment, the number of the second circuit paths is less than the number of the haptic actuators. At least one of the second circuit paths has more than one of the second contacts, so that the number of the second contacts can be the same as the number of the haptic actuators.

BRIEF DESCRIPTION OF THE DRAWINGS

FIG. 4B-1 is a schematic view showing the arrangement of the first circuit paths of FIG. 4B;

FIG. 4B-2 is a schematic view showing the arrangement of the second circuit paths of FIG. 4B;

DETAILED DESCRIPTION OF THE PREFERRED EMBODIMENT

The invention provides a keyswitch structure having haptic feedback and an input device having the keyswitch structure. Particularly, the input device of the invention can be any input device having the keyswitch structure, such as an independent keyboard device, an input device integrated into electronic devices, such as the key button or keyboard provided in portable devices or tablet computers, but not limited thereto. Hereafter, a computer keyboard is illustrated as an example to explain the details of the keyswitch structure and the input device of the invention.

Figure 1A:
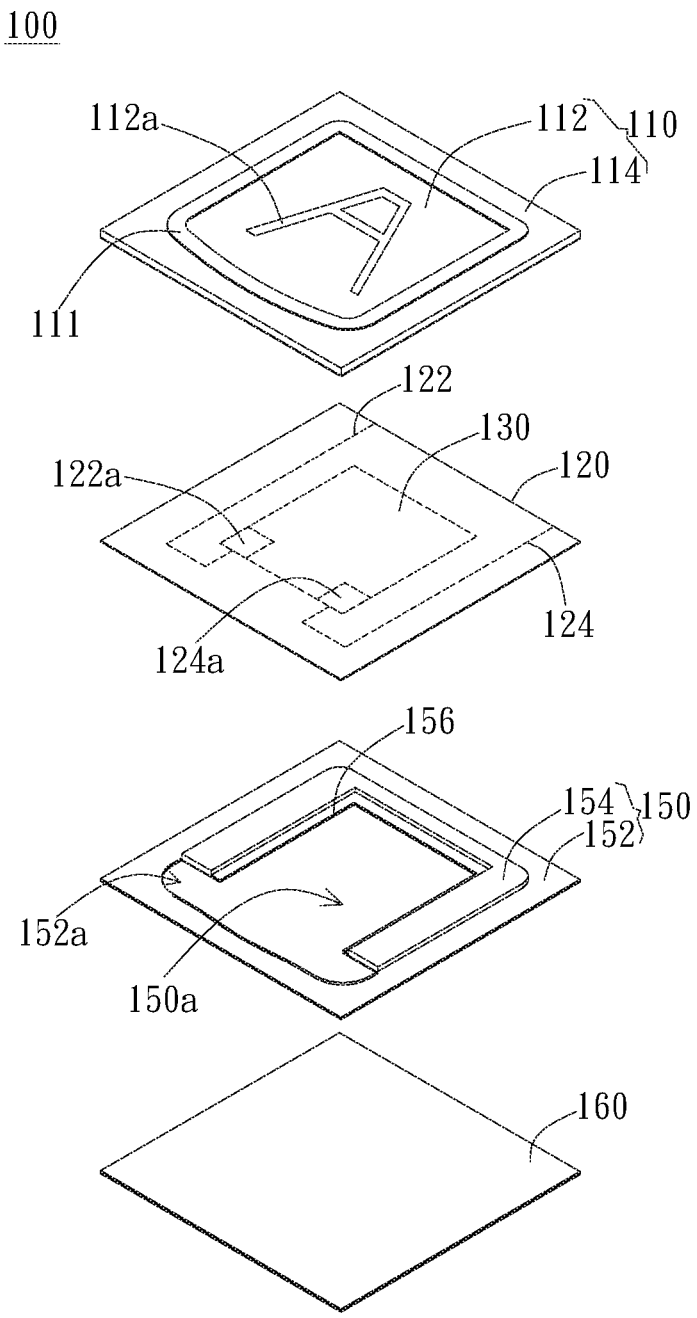
FIG. 1A is an exploded view of the keyswitch structure according to an embodiment of the invention.
Figure 1B:
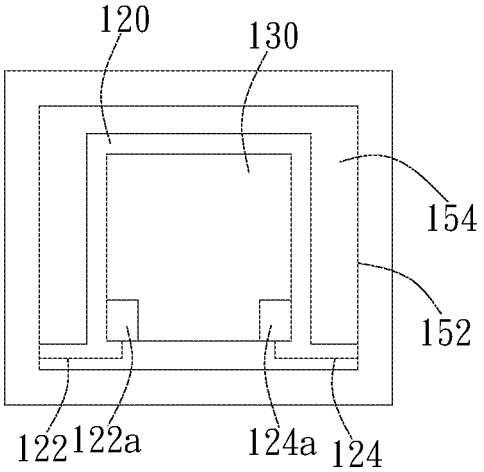
FIG. 1B is a schematic view showing the arrangement of the keyswitch structure including the circuit layer, the haptic actuator, and the cushion layer according to an embodiment of the invention.
Figure 1C:
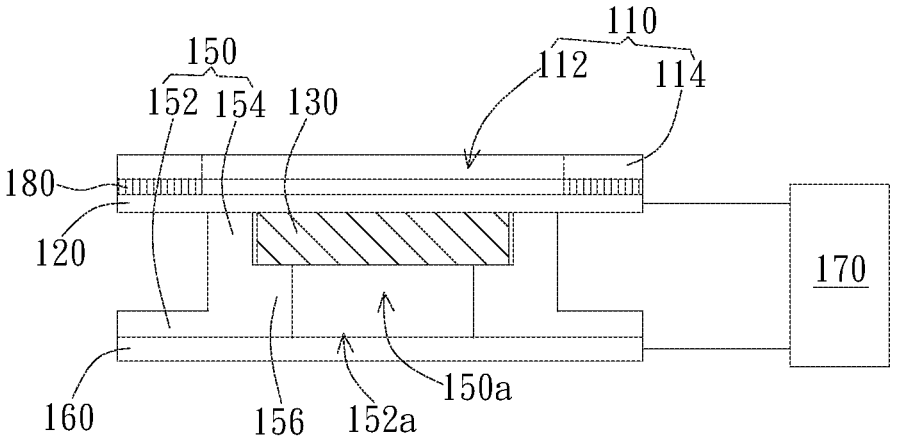
FIG. 1C is a cross-sectional view of FIG. 1A.

As shown in FIGS. 1A to 1C, in an embodiment, the keyswitch structure 100 is a multi-layered film structure and includes a keycap layer 110, a circuit layer 120, at least one haptic actuator 130, a cushion layer 150, a sensing unit 160, and a control circuit 170 (see FIG. 1C). In this embodiment, the keycap layer 110 has a keycap region 112 as a designated area for user to operate or press the keyswitch structure 100. The circuit layer 120 is disposed under the keycap layer 110 and serves as (a) a circuit path layer to transmit a driving signal D and (b) a substrate layer to carry the haptic actuator 130. The haptic actuator 130 is disposed under and electrically connected to the circuit layer 120. When receiving the driving signal D, the haptic actuator 130 provides a haptic feedback, such as vibration, so that the haptic actuator 130 serves as a source of the haptic feedback in response to user's pressing the keycap layer 110. The cushion layer 150 is disposed under the circuit layer 120 and serves as (a) a force-transferring layer to transfer an external force exerted along the vertical direction as well as (b) a supporting structure layer to support the circuit layer 120. The sensing unit 160 is disposed under the cushion layer 150. The sensing unit 160 outputs a trigger signal T whenever the sensing unit 160 is triggered. The control circuit 170 couples the sensing unit 160 and the circuit layer 120 and can be disposed at any suitable position within the keyboard according to practical application needs. Whenever receiving the trigger signal T, the control circuit 170 outputs a sensing signal and the driving signal D.

Particularly, the cushion layer 150 has an accommodation space 150*a* for accommodating the haptic actuator 130. The circuit layer 120 is electrically connected to the haptic actuator 130, so the control circuit 170 can electrically couple the haptic actuator 130 through the circuit layer 120. The cushion layer 150 transfers the external force. That is, when the external force is applied on the keycap region 112, the external force is delivered downwardly through the cushion layer 150 to trigger the sensing unit 160. The sensing unit 160 is a membrane switch type sensing layer. Whenever triggered by the external force, the sensing unit 160 outputs the trigger signal T to the control circuit 170. The control circuit 170 then outputs both (1) the sensing signal to a computer to indicate the user enters a specified character input, and (2) the driving signal D that drives the haptic actuator 130 to provide haptic feedback, such as vibration feedback. The circuit layer 120 has at least one first contact 122*a* and at least one second contact 124*a* on the bottom surface of the circuit layer 120 that corresponds to the keycap region 112. The first contact 122*a* is electrically isolated from the second contact 124*a*. The at least one haptic actuator 130 is accommodated in the accommodation space 150*a* of the cushion layer 150 and electrically connected to the first contact 122*a* and the second contact 124*a*. The sensing unit 160 outputs the trigger signal T whenever the sensing unit 160 is triggered, and the control circuit 170 outputs the driving signal D to drive the haptic actuator 130 whenever the control circuit 170 receives the trigger signal T (described later with reference to FIG. 1D).

Moreover, the "haptic actuator" generally refers to any suitable component that can be driven by the driving signal D to provide haptic feedback, such as vibration. The haptic actuator includes, not limited to, piezoelectric actuator, voice coil actuator, pager motor, solenoid, or other type haptic actuators. The piezoelectric actuator is small in size and very thin, so the piezoelectric actuator is very suitable for use in the keyswitch having the multi-layered film structure. Hereinafter, the piezoelectric actuator is adopted for explaining the detailed structure and correlation of the elements of the keyswitch structure.

As shown in FIGS. 1A to 1C, the keycap layer 110 is disposed on the circuit layer 120 and has the keycap region 112 and a peripheral region 114, wherein the peripheral region 114 is adjacently connected to the periphery of the keycap region 112. The keycap region 112 corresponds to the haptic actuator 130 and serves as a pressing region for the user to press or operate the keyswitch structure, and the peripheral region 114 is physically attached to the underlying circuit layer 120. In this embodiment, the peripheral region 114 is disposed to surround the keycap region 112, and the keycap region 112 has a character or pattern 112*a* to indicate the command or character that will be inputted by the keyswitch structure. Moreover, an area-identifier 111 is provided on the keycap layer 110 to define the area of the keycap region 112, so that the user can easily identify the location of the keycap region 112 to promote the pressing accuracy. In other words, the area-identifier 111 is disposed on the boundary between the keycap region 112 and the peripheral region 114 to define the keycap region 112 and the peripheral region 114. In this embodiment, the area-identifier 111 can be a raised frame, wherein the inner region of the raised frame (or as well as the raised frame itself) is defined as the keycap region 112, and the outer region of the raised frame is defined as the peripheral region 114. During blind-typing, the user can identify the location of the keycap region 112 by means of the area-identifier 111 that protrudes from the periphery of the keycap region 112 to promote the typing speed and the typing accuracy. Moreover, the area-identifier 111 and the character or pattern 112*a* can be formed on the upper surface of the keycap layer 110 by printing, press-printing, adhering, laser-carving, etc. The area-identifier 111 and the character or pattern 112*a* may have different configurations, not limited to the embodiment.

The thickness of the keycap layer 110 is preferably in a range of 0.075~2 mm, and the keycap layer 110 is preferably made of flexible or soft material to increase the comfortability when the user presses the keyswitch structure 100. When the user presses the keycap region 112, the flexible or soft material has relatively lower hardness to improve the pressing comfortability, and the energy loss in the radial direction of the pressing point is relatively smaller. In addition, the keycap region 112 provides a better reflexibility in response to the haptic feedback due to the flexible or soft characteristics. When the reflexibility of the keycap region 112 is higher, the thickness of the keycap region 112 at the depressing point is smaller, and the path of transmitting energy to the user (e.g. finger) is shorter, so that the kinetic energy loss of the haptic actuator 130 occurring during vibration can be reduced. The keycap layer 110 can be made from a material selected from the group consisting of polyurethane (PU), thermalplastic polyurethane (TPU), leather, textile, and silicone.

In an embodiment, the keycap layer 110 can be disposed only over the circuit layer 120 to be the topmost layer of the keyswitch structure 100. In this case, the keyswitch structure 100 can optionally include a keyboard frame to integrate all components in the keyboard frame and expose the keycap layer 110 for user to operate. Moreover, the keyswitch structure 100 may optionally include a baseplate (not shown). The baseplate is disposed under the sensing unit 160 to increase the structural strength of the keyswitch structure 100. The baseplate is preferably made of a material having relatively higher rigidity, such as metal plate, hard plastics or polymers, to maintain the structural strength of the keyswitch structure 100 and prevent the keyswitch structure 100 from damage caused by overbending. In another embodiment, the keycap layer 110 can be a cover layer to encapsulate all components of the keyswitch structure 100, but not limited thereto.

The circuit layer 120 has a thin film or sheet-like configuration and is preferably made of a material having a relatively higher rigidity to serve as a substrate layer to carry the haptic actuator 130. The thickness of the circuit layer 120 is preferably in a range of 0.05~0.5 mm. The circuit layer 120 includes an insulation layer and conductive circuit paths (i.e. circuit) formed on the insulation layer. The insulation layer can be made of polyethylene terephthalate (PET), for example. That is, the hardness of the circuit layer 120 is harder than the hardness of the keycap layer 110, and the thickness of the circuit layer 120 is preferably smaller than the thickness of the keycap layer 110. As shown in FIGS. 1A and 1B, the circuit layer 120 is disposed under the keycap layer 110, and the circuit layer 120 has at least one first contact 122*a* and at least one second contact 124*a* on a bottom surface of the circuit layer 120. The first contact 122*a* is electrically isolated from the second contact 124*a*. Particularly, the circuit layer 120 has a first circuit path 122 and a second circuit path 124, and the first circuit path 122 and the second circuit path 124 construct a circuit loop, so that the driving signal D can be transmitted from the control circuit 170 to the haptic actuator 130. The first circuit path 122 and the second circuit path 124 are electrically isolated and disposed on the bottom surface of the circuit layer 120. The first circuit path 122 includes the first contact 122*a*, and the second circuit path 124 includes the second contact 124*a*. That is, the first circuit path 122 and the second circuit path 124 are disposed on one side of the circuit layer 120 (i.e. bottom side) opposite to the keycap layer 110, so that the haptic actuator 130 and the keycap layer 110 are disposed on two opposite sides of the circuit layer 120, respectively.

In this embodiment, the haptic actuator 130 includes piezoelectric materials and preferably in a sheet or film configuration. The piezoelectric materials can be piezoelectric single crystal, piezoelectric polycrystalline (piezoelectric ceramics), piezoelectric polymers, or piezoelectric composite materials, but not limited thereto. The haptic actuator 130 is disposed under the circuit layer 120 and electrically connected to the first contact 122*a* of the first circuit path 122 and the second contact 124*a* of the second circuit path 124, so that the driving signal D can be transmitted from the control circuit 170 to the haptic actuator 130 through the circuit paths 122, 124 to drive the haptic actuator 130 to provide the haptic feedback, such as vibration feedback. It is noted that the haptic actuator 130 is preferably physically connected to the circuit layer 120 by means of the connection to the first contact 122*a* and the second contact 124*a* and keeps separated from or non-adhered to other portions of the circuit layer 120, so that the haptic actuator 130 can provide a larger vibration effect. For example, the haptic actuator 130 can be electrically connected to the first contact 122*a* and the second contact 124*a* by silver glue, solder, or any suitable electrical connection materials to physically attach to the circuit layer 120, so that most portions of the haptic actuator 130 remain unattached or non-adhered to the circuit layer 120 to provide a greater vibration effect. However, in another embodiment, as the haptic actuator 130 itself is capable of providing sufficient vibration, in addition to the first contact 122*a* and the second contact 124*a*, the haptic actuator 130 can be physically attached to other portions of the circuit layer 120 to enhance the adhesion of the haptic actuator 130 to the circuit layer 120 and prevent the detachment of the haptic actuator 130 from the circuit layer 120. Moreover, with respect to the circuit layer 120, the vibration direction of the haptic actuator 130 can include up/down butterfly type vibration or horizontal contraction, and the vibration manner can include continuous vibration or pulse vibration, but not limited thereto.

As shown in FIGS. 1A to 1C, the cushion layer 150 is disposed under the circuit layer 120. The cushion layer 150 has an accommodation space 150*a* for accommodating the haptic actuator 130. Particularly, the cushion layer 150 includes a film portion 152 and a protrusion portion 154. The film portion 152 has an accommodation area 152*a*, and the protrusion portion 154 is disposed around the accommodation area 152*a* and extends from the film portion 152 toward the circuit layer 120 to define the accommodation space 150*a* over the accommodation area 152*a*, so that the haptic actuator 130 can be accommodated and vibrate in the accommodation space 150*a*. In this embodiment, the film portion 152 has a through hole as the accommodation area 152*a*. In other words, the protrusion portion 154 is disposed around the through hole 152*a* and extends beyond the upper surface of the film portion 152 toward the circuit layer 120 to define the accommodation space 150*a* over the accommodation area 152*a* (i.e. the through hole). As such, the top surface of the protrusion portion 154 is higher than the top surface of the film portion 152, and the through hole 152*a* communicates with the accommodation space 150*a*. It is noted that the accommodation area 152*a* of the film portion 152 can have other configurations and not limited to the through hole. In another embodiment, the accommodation area 152*a* of the film portion 152 can be a portion of the surface region of the film portion 152 or a recessed region of the film portion 152. Moreover, the accommodation area 152*a* is preferably disposed at a location corresponding to the keycap region 112. According to the design needs, the accommodation area 152*a* can have any suitable shapes other than the rectangular shape shown in FIG. 1A. In other embodiments (not shown), the accommodation area 152*a* can have a circular shape, an oval shape, or any suitable shapes. Corresponding to the shape of the accommodation area 152*a*, the protrusion portion 154 can be disposed to surround a portion of the periphery of the accommodation area 152*a* or substantially the entire periphery of the accommodation area 152*a*. For example, as shown in FIGS. 1A and 1B, as the accommodation area 152*a* corresponding to the keycap region 112 has a rectangular shape, the protrusion portion 154 can be disposed to surround three sides of the accommodation area 152*a* and only one side of the accommodation area 152*a* that corresponds to the location of the first contact 122*a* and the second contact 124*a* is disposed without the protrusion portion 154. In other words, the protrusion portion 154 of the cushion layer 150 has a U-shaped configuration with an opening. The first circuit path 122 and the second circuit path 124 are electrically connected to the first contact 122*a* and the second contact 124*a* through the opening of the U-shaped configuration, respectively. In another embodiment, as shown in FIG. 2F, when the accommodation area 152*a* corresponding to the keycap region 112 has a circular shape, the protrusion portion 154 can be disposed to surround substantially the entire periphery of the accommodation area 152*a*, except the portion of the periphery corresponding to the location of the first contact 122*a* and the second contact 124*a*. In this embodiment, the protrusion portion 154 is a continuous protrusion structure, but not limited thereto. In another embodiment, the protrusion portion 154 can be a non-continuous structure. That is, the protrusion portion 154 can include a plurality of raised blocks or pillars disposed around the accommodation area 152*a*. As the cushion layer 150 serves as the supporting structure layer of the circuit layer 120, the thickness of the protrusion portion 154 is preferably larger than the thickness of the haptic actuator 130. When the haptic actuator 130 vibrates within the accommodation space 150*a*, the thickness of the protrusion portion 154 is sufficient to provide appropriate vibration space for the haptic actuator 130. That is, there is enough space provided under the haptic actuator 130 to achieve the haptic feedback.

In an embodiment, the cushion layer 150 further has an extension portion 156 extending from the protrusion portion 154 toward the inner side of the accommodation space 150*a*. The extension portion 156 has a top surface lower than the top surface of the protrusion portion 154. As shown in FIG. 1C, as the haptic actuator 130 is accommodated in the accommodation space 150*a*, the haptic actuator 130 preferably at least partially abuts on the top surface of the extension portion 156. In other words, the top surface of the extension portion 156 is preferably higher than the top surface of the film portion 152 and lower than the bottom surface of the haptic actuator 130, and the extension portion 156 preferably extends toward the inner side of the accommodation space 150*a* to be partially disposed under the bottom surface of the haptic actuator 130. As such, the protrusion portion 154 extends upward from the film portion 152 can provide the vibration space (e.g. 150*a*) under the keycap layer 110 for the haptic actuator 130, and the extension portion 156 provides underlying support during vibration of the haptic actuator 130 to prevent the haptic actuator 130 from pressing against the sensing unit 160.

The cushion layer 150 is preferably made of cushion materials having hardness equal to or lower than 70 A, and more preferably 10 A~60 A by the laser or hot-press molding technique. In an embodiment, the cushion layer 150 is made of silicone materials. In other words, the cushion layer 150 is made of soft materials to prevent the sensing unit 160 from inadvertently generating a false trigger signal caused by the weight of the cushion layer 150 when the keycap layer 110 is not pressed. As described above, the cushion layer 150 transfers the force to the underlying sensing unit 160 and triggers the sensing unit 160 to output the trigger signal T. In this embodiment, the force can be transferred through two paths to the sensing unit 160, for example, (1) through the circuit layer 120 and the protrusion portion 154, (2) through the circuit layer 120, the haptic actuator 130, and the extension portion 156. In an embodiment, as shown in FIG. 1C, the outer sidewall of protrusion portion 154 is preferably substantially aligned with the boundary of the keycap region 112 or slightly exceeds the boundary of the keycap region 112, so that when the user presses the keycap region 112 on the boundary, the force still can be transferred downwardly through the protrusion portion 154, but not limited thereto. Moreover, when the user accidently presses outside the keycap region 112 (i.e. presses the peripheral region 114), the pressing force will not be transferred downwardly through the protrusion portion 154 to the sensing unit 160 since substantially no protrusion portion 154 is disposed under the peripheral region 114, and therefore the sensing unit 160 is prevented from generating a false trigger signal.

In an embodiment, as shown in FIG. 1C, the keyswitch structure 100 further includes an adhesive layer 180. The adhesive layer 180 is disposed on a bottom surface of the keycap layer 110 outside the keycap region 112, so that only the portion of the keycap layer 110 corresponding to the peripheral region 114 is adhered to the circuit layer 120 by the adhesive layer 180. Particularly, no adhesive layer 180 is disposed on the bottom surface of the keycap layer 110 that corresponds to the keycap region 112, so that the bottom surface of the keycap region 112 is not adhered to the circuit layer 120 or is separated from the circuit layer 120 by a gap. As such, when the haptic actuator 130 is driven by the driving signal D to vibrate, the kinetic energy loss of the haptic actuator 130 occurring during vibration can be reduced. That is, if the entire keycap layer 110 is adhered to the circuit layer 120, the "load" of the haptic actuator 130 is increased and the vibration of the haptic actuator 130 becomes more difficult, resulting in the increase in kinetic energy loss. In this embodiment, the thickness of the adhesive layer 180 is preferably less than 0.5 mm, but not limited thereto. Moreover, the remaining components of the keyswitch structure 100, such as the circuit layer 120, the cushion layer 150, and the sensing unit 160 can be connected by adhesives to fix the relative positions among the components.

Figure 1D:
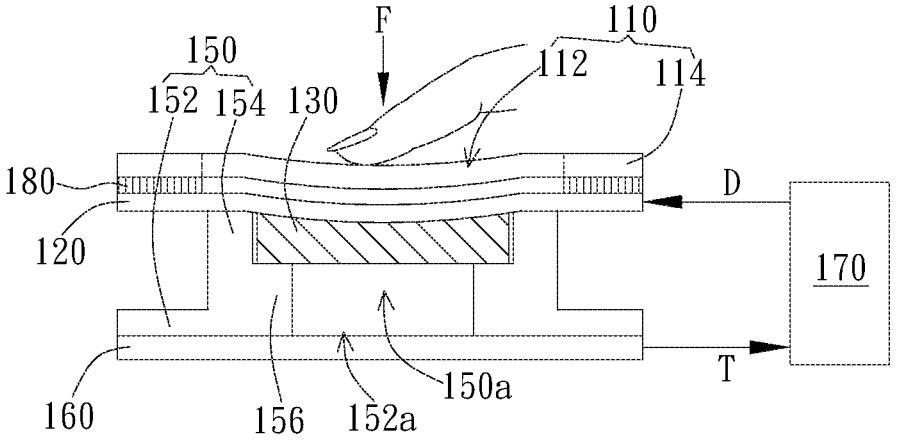
FIG. 1D is a schematic view showing the operation of FIG. 1A.

As shown in FIG. 1D, when an external force F is applied, the force F is delivered downwardly through the cushion layer 150 to trigger the sensing unit 160, so that the sensing unit 160 outputs the trigger signal T to the control circuit 170. Upon receiving the trigger signal T, the control circuit 170 outputs the driving signal D to drive the haptic actuator 130, so that the haptic actuator 130 can provide the haptic feedback, such as vibrations. That is, when the user presses the keyswitch structure 100 on the keycap region 112 of the keycap layer 110, by means of the structural characteristics of the cushion layer 150, such as the protrusion portion 154 and/or the extension portion 156, the pressing force can be transferred downwardly through at least one of the two paths as described above, so that the sensing unit 160 is triggered to output the trigger signal T. The trigger signal T not only serves as a sensing signal for inputting the corresponding character or command of the keyswitch structure 100, but also as an indicating signal for generating the driving signal D, so that the control circuit 170 can output the driving signal D upon receiving the trigger signal T. When the haptic actuator 130 receives the driving signal D from the control circuit 170 through the circuit paths of the circuit layer 120, such as the first circuit path 122 and the second circuit path 124, the haptic actuator 130 vibrates within the accommodation space 150*a* to provide the vibration feedback of confirming the key-pressing operation.

Figure 2A:
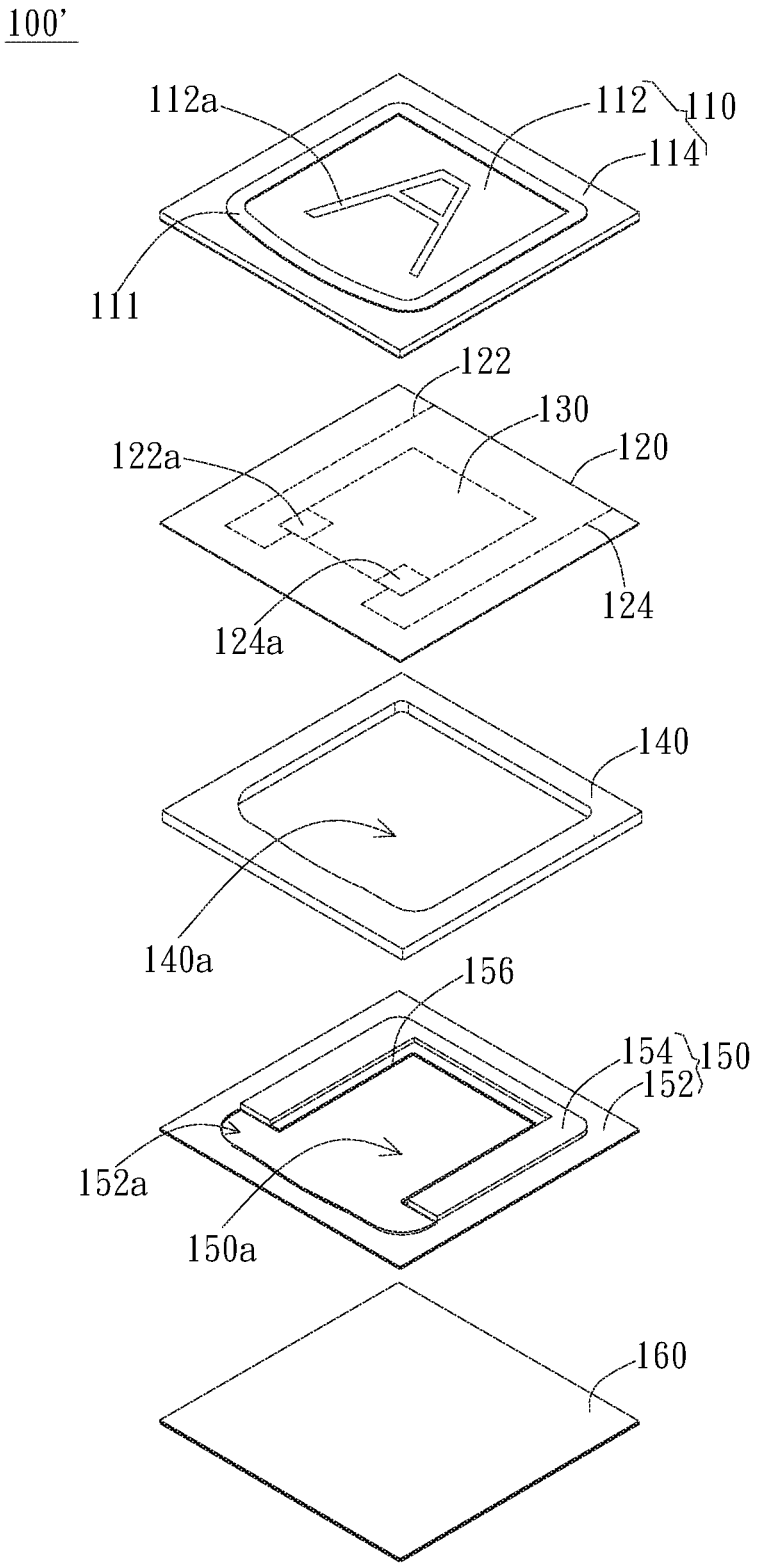
FIG. 2A is an exploded view of the keyswitch structure according to another embodiment of the invention.
Figure 2B:
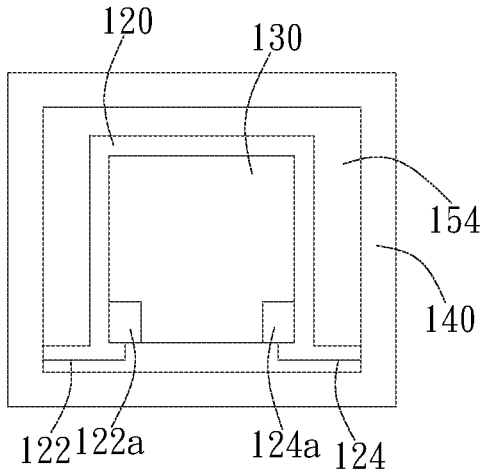
FIG. 2B is a schematic view showing the arrangement of the keyswitch structure including the circuit layer, the haptic actuator, the support layer and the cushion layer according to another embodiment of the invention.
Figure 2C:
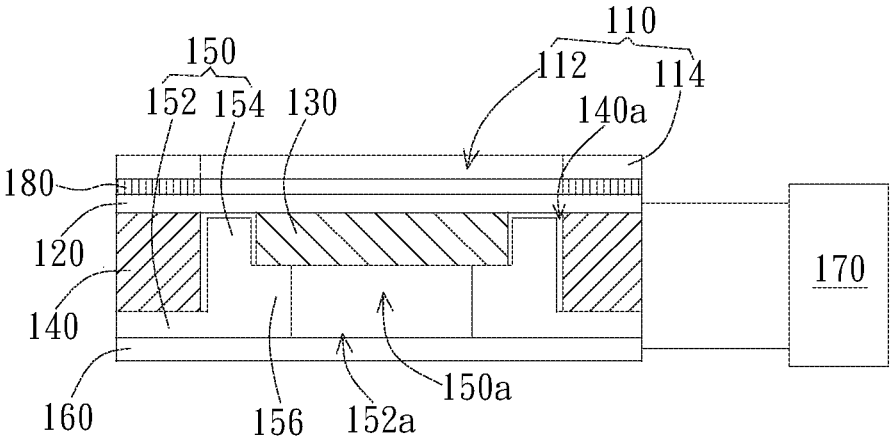
FIG. 2C is a cross-sectional view of FIG. 2A.

In another embodiment, as shown in FIGS. 2A to 2D, the keyswitch structure 100' further includes a support layer 140 to support the circuit layer 120. The support layer 140 is disposed between the circuit layer 120 and the sensing unit 160 and can be the major support structure for the keyswitch structure 100' to keep the circuit layer 120 away from the sensing unit 160 by a predetermined distance and provide sufficient vibration space for the haptic actuator 130. In an embodiment, the predetermined distance makes the haptic actuator 130 be separated from the sensing unit 160 preferably by at least 0.8 mm. In this embodiment, the support layer 140 is disposed on the film portion 152 and has an opening 140*a*. The protrusion portion 154 protrudes into the opening 140*a* toward the circuit layer 120. That is, the opening 140*a* preferably corresponds to the keycap region 112 of the keycap layer 110 and the area of the opening 140*a* covers the protrusion portion 154 that surrounds the accommodation area 152*a*. As such, when the support layer 140 is disposed on the film portion 152, the protrusion portion 154 is inserted into the opening 140*a*, as shown in FIG. 2C. The hardness of the support layer 140 is preferably higher than the hardness of the cushion layer 150, and the thickness of the support layer 140 is larger than the thickness of the haptic actuator 130, so that the circuit layer 120 and the sensing unit 160 maintain the predetermined distance separated from each other to provide the vibration space for the haptic actuator 130. In other words, when the user exerts larger force on the keycap layer 110, the support layer 140 can ensure the haptic actuator 130 with sufficient vibration space, so that the haptic actuator 130 is likely not to press against the sensing unit 160, and the vibration of the haptic actuator 130 will not be impaired due to the compressed accommodation space 150*a* caused by the excessive deformation of the cushion layer 150, which has insufficient hardness. Consequently, the decrease of haptic feedback provided by the haptic actuator 130 can be prevented. Alternatively, in the embodiment of FIG. 1A, if the cushion layer 150 is able to sustain the pressing force without excessive deformation and the accommodation space 150*a* is not overly compressed, the support layer 140 is an optional layer, so that the cushion layer 150 functions not only the force-transferring layer but also the supporting structure layer.

In an embodiment, when the protrusion portion 154 of the cushion layer 150 extends into the opening 140*a* of the support layer 140, the top surface of the support layer 140 is preferably substantially equal to or slightly higher than the top surface of the protrusion layer 154 to support the circuit layer 120 and the keycap layer 120, but not limited thereto. The thickness of the support layer 140 depends on the thickness of the haptic actuator 130 and the height of the vibration space. For example, when the height of the vibration space is equal to or larger than 0.8 mm, the haptic actuator 130 will have a better vibration effect. Therefore, the thickness of the support layer 140 is preferably designed to be larger than the thickness of the haptic actuator 130 and able to maintain a vibration space having a height of 0.8 mm or larger under the haptic actuator 130 when pressing the keycap layer 110. In an embodiment, the opening 140*a* of the support layer 140 preferably corresponds to the keycap region 112. In other words, the shape, size and location of the opening 140*a* preferably correspond to those of the keycap region 112, so that when the user presses the keycap region 112, the pressing force can be delivered to the sensing unit 160 through the force-transferring portion of the cushion layer 150, such as the protrusion portion 154 and/or the extension portion 156. Moreover, the sensing circuit of the sensing unit 160 is preferably disposed right under the force-transferring portion of cushion layer 150, so that the pressing force exerted on the keycap region 112 can be transferred through at least one of the above two paths to trigger the sensing unit 160 normally, and the possibility of miss-triggering the sensing unit 160 by exerting force on the non-keycap region through the support layer 140 can be reduced.

Figure 2D:
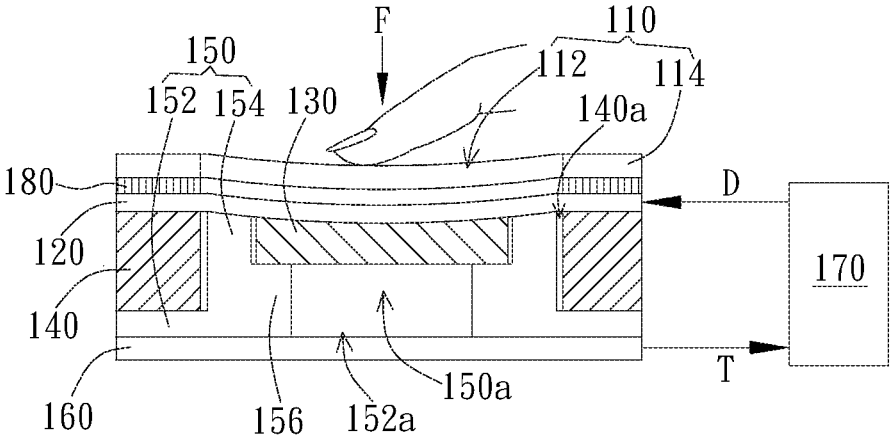
FIG. 2D is a schematic view showing the operation of FIG. 2A.

As shown in FIG. 2D, when an external force F is applied to the keycap region 112, the force F is delivered downwardly through the cushion layer 150 to trigger the sensing unit 160, and then the sensing unit 160 outputs the trigger signal T to the control circuit 170. Upon receiving the triggering signal T, the control circuit 170 outputs the driving signal D to the haptic actuator 130 to drive the haptic actuator 130. In other words, when the user presses the keyswitch structure 100 on the keycap region 112 of the keycap layer 110, under the pressing force, the support layer 140 still provides sufficient vibration space for the haptic actuator 130, and the pressing force is downwardly transferred through at least one of the above two paths by the protrusion portion 154 and/or the extension portion 156 of the cushion layer 150 to trigger the sensing unit 160 to output the trigger signal T. The trigger signal T not only serves as a sensing signal for inputting the corresponding character or command of the keyswitch structure 100, but also as an indicating signal for generating the driving signal D, so that the control circuit 170 can output the driving signal D upon receiving the trigger signal T. When the haptic actuator 130 receives the driving signal D from the control circuit 170 through the circuit paths of the circuit layer 120, such as the first circuit path 122 and the second circuit path 124, the haptic actuator 130 vibrates within the accommodation space 150*a* to provide the vibration feedback for the user to confirm the key-pressing operation.

Figure 2E:
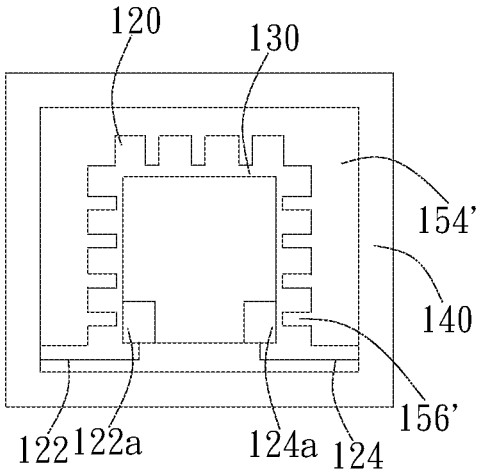
FIG. 2E is a schematic view showing the arrangement of the keyswitch structure including the circuit layer, the haptic actuator, the support layer and the cushion layer according to another embodiment of the invention.
Figure 2F:
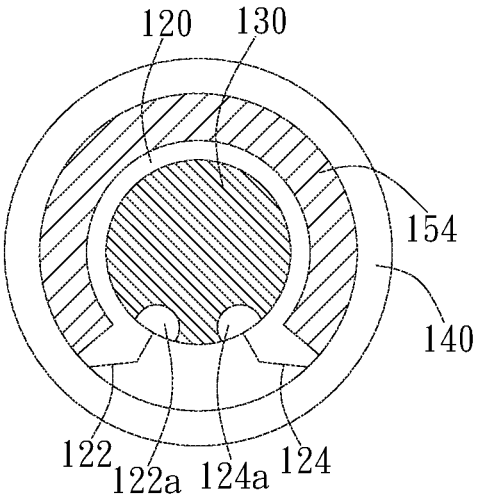
FIG. 2F is a schematic view showing the arrangement of the keyswitch structure including the circuit layer, the haptic actuator, the support layer and the cushion layer according to yet another embodiment of the invention.

In the embodiments of FIGS. 1A and 2A, the extension portion 156 continuously extends along the protrusion portion 154 toward the inner side of the accommodation space 150*a*. However, in another embodiment, as shown in FIG. 2E, the extension portion 156' can extend toward the inner side of the accommodation space 150*a* in a non-continuous manner to increase the design flexibility and meet the design requirements.

Moreover, the opening 140*a* of the support layer 140 has a first top-view contour; the accommodation space 150*a* of the cushion layer 150 has a second top-view contour; the haptic actuator 130 has a third top-view contour. All of the first, second, and third top-view contours have same shape, such as all quadrilateral shape (as shown in FIG. 2A), circular shape (as shown in FIG. 2F), or other suitable shape, but not limited to the embodiments.

Figure 3A:
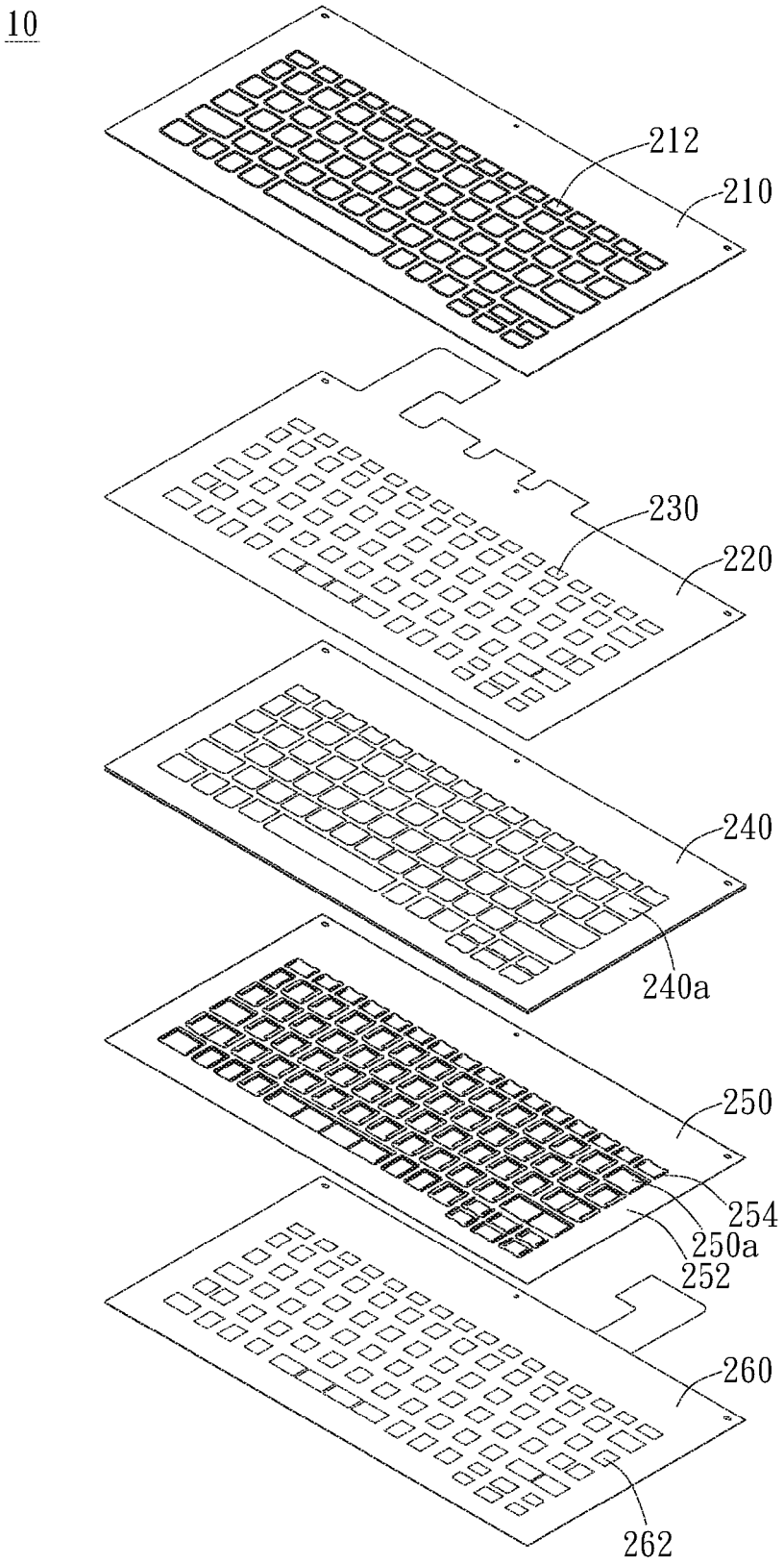
FIGS. 3A and 3B are an exploded view and an assembled view of the input device according to an embodiment of the invention, respectively.
Figure 3B:
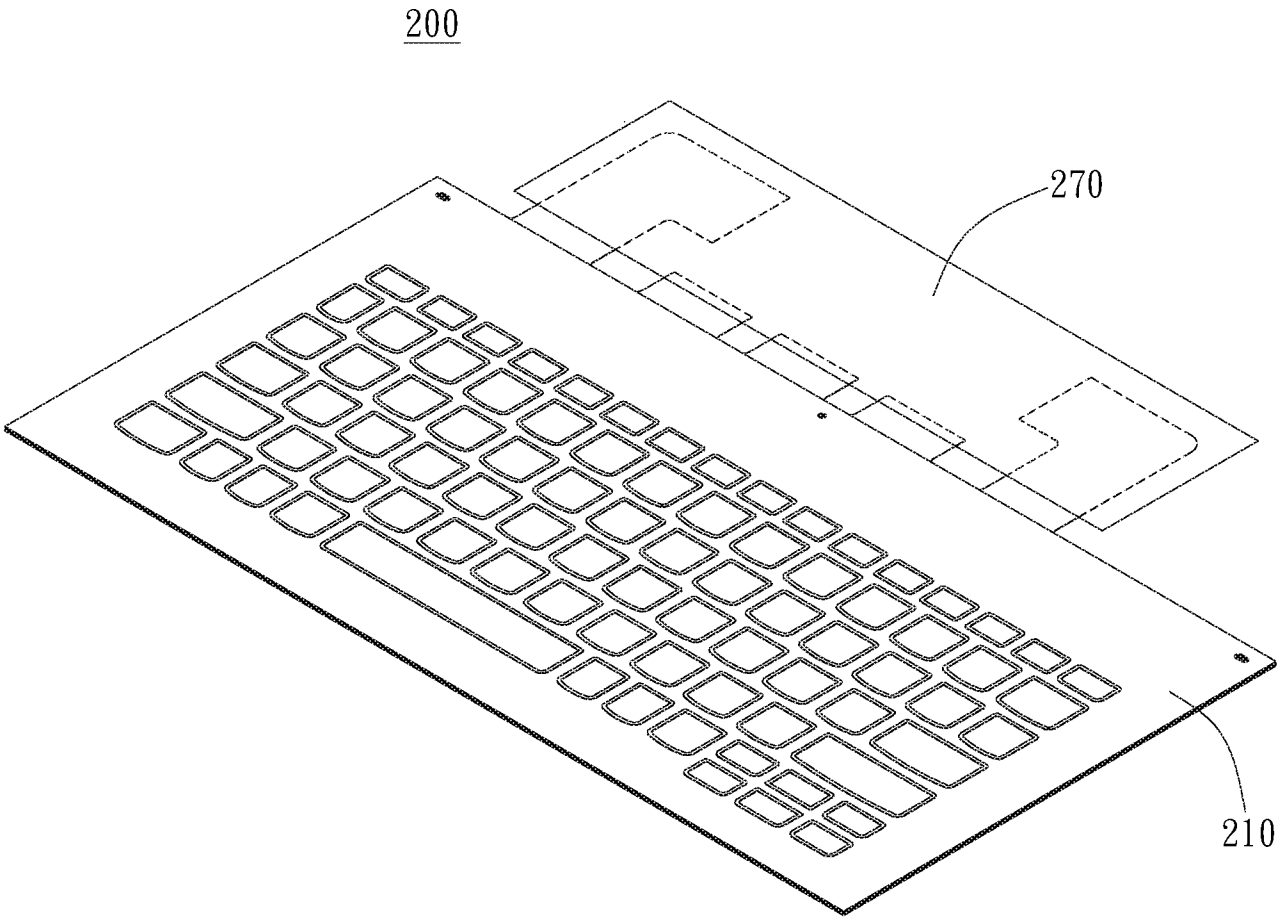

As shown in FIGS. 3A and 3B, in another embodiment, an input device 10 includes multiple keyswitch structures of the previous embodiments is provided. It is noted, in this embodiment, the input device 10 is illustrated as a computer keyboard device, but in other embodiments, the input device can include one or more keyswitch structures which can be arranged in any suitable manner. Moreover, in this embodiment, the input device 10 is illustrated to include the keyswitch structure of FIG. 2A, but not limited thereto. The input device of the invention can include one or more keyswitch structures selected from the keyswitch structure of FIG. 1A, FIG. 2A, FIG. 2E, FIG. 2F, or the combination thereof.

As shown in FIG. 3A, the input device 10 includes a keycap layer 210, a circuit layer 220, a plurality of haptic actuators 230, a cushion layer 250, a sensor layer 260, and a control circuit 270 (shown in FIG. 3B). Optionally, the input device 10 further includes a support layer 240. The keycap layer 210 has a plurality of keycap regions 212. The circuit layer 220 is disposed under the keycap layer 210. As shown in FIG. 4B, the circuit layer 220 has a plurality of first contacts 222*a* and a plurality of second contacts 224*a* on a bottom surface of the circuit layer 220. The first contacts 222*a* are electrically isolated from the second contacts 224*a*, and each of the keycap regions 212 is corresponding to at least one of the first contacts 222*a* and at least one of the second contacts 224*a*. The cushion layer 250 is disposed under the circuit layer 220. The cushion layer 250 has a plurality of accommodation spaces 250*a*. Each of the plurality of keycap regions 212 is corresponding to at least one of the accommodation spaces 250*a*, and each of the accommodation spaces 250*a* accommodates at least one of the plurality of haptic actuators 230. The sensor layer 260 is disposed under the cushion layer 250. The sensor layer 260 includes a plurality of sensing units 262. Each of the plurality of keycap regions 212 corresponds to at least one of the sensing units 262, and each of the sensing units 262 is capable of being triggered to output a trigger signal T. In other words, when multiple keyswitch structures are integrated into the input device 10, such as a computer keyboard, the corresponding components of the keyswitch structures can be integrated into a single component layer.

Figure 4A:
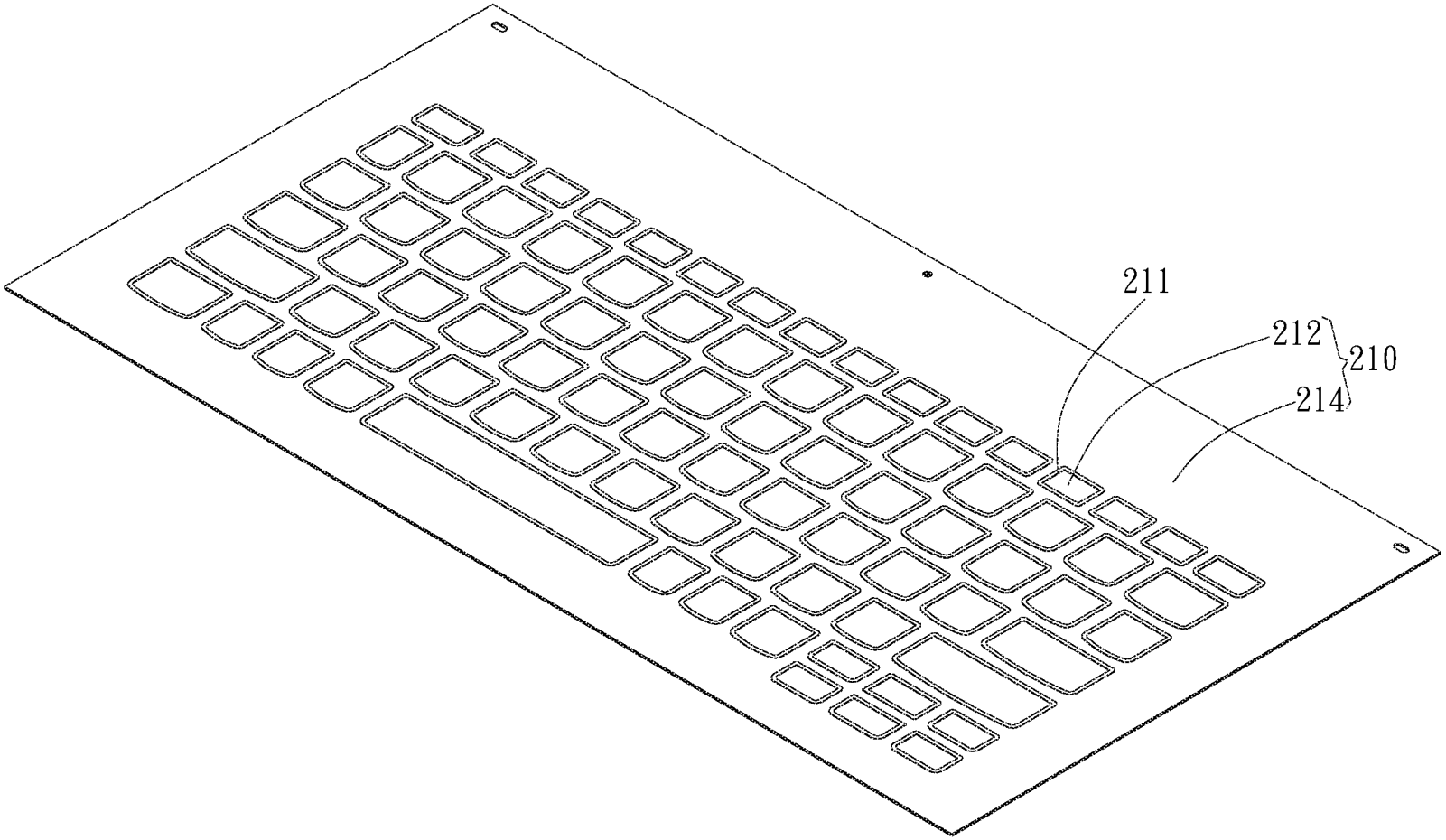
FIG. 4A is a schematic view of the keycap layer of FIG. 3A.
Figure 4B:
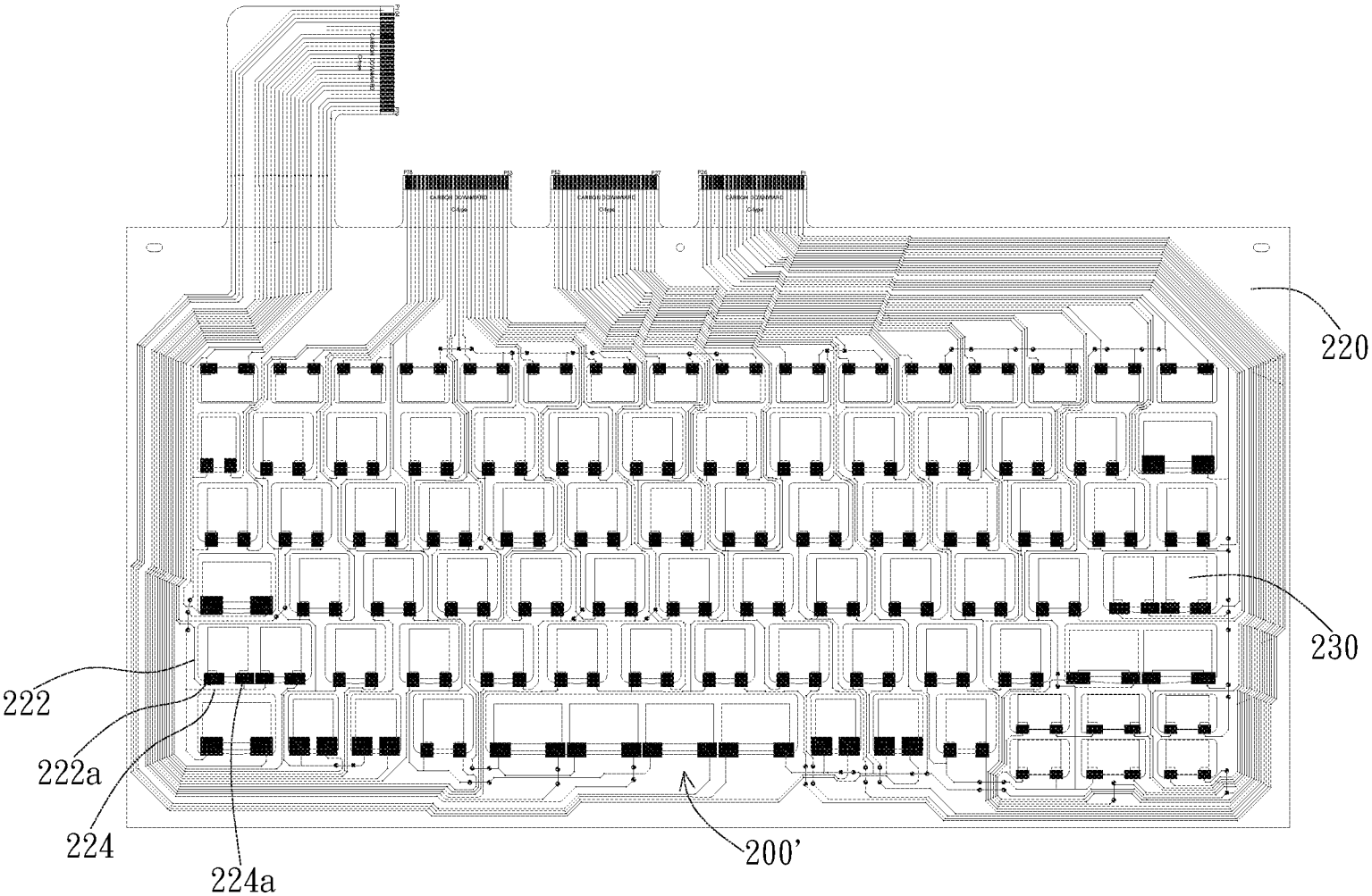
FIG. 4B is a schematic view of the circuit layer of FIG. 3A.

For example, as shown in FIGS. 3A and 4A, multiple keycap regions 212 can be connected by the peripheral region 214 to form a single keycap layer 210. Particularly, the keycap layer 210 can have a plurality of area-identifiers 211 to define the area of each keycap region 212, and the portion of the keycap layer 210 abutting the keycap regions 212 is the peripheral region 214. Similarly, each keycap region 212 has a corresponding character or pattern to indicate the command or character to be inputted by each keyswitch structure. In this embodiment, the keycap layer 210 can have similar properties as the keycap layer 110, such as material, thickness and will not be elaborated again.

Figures 1, 4B:
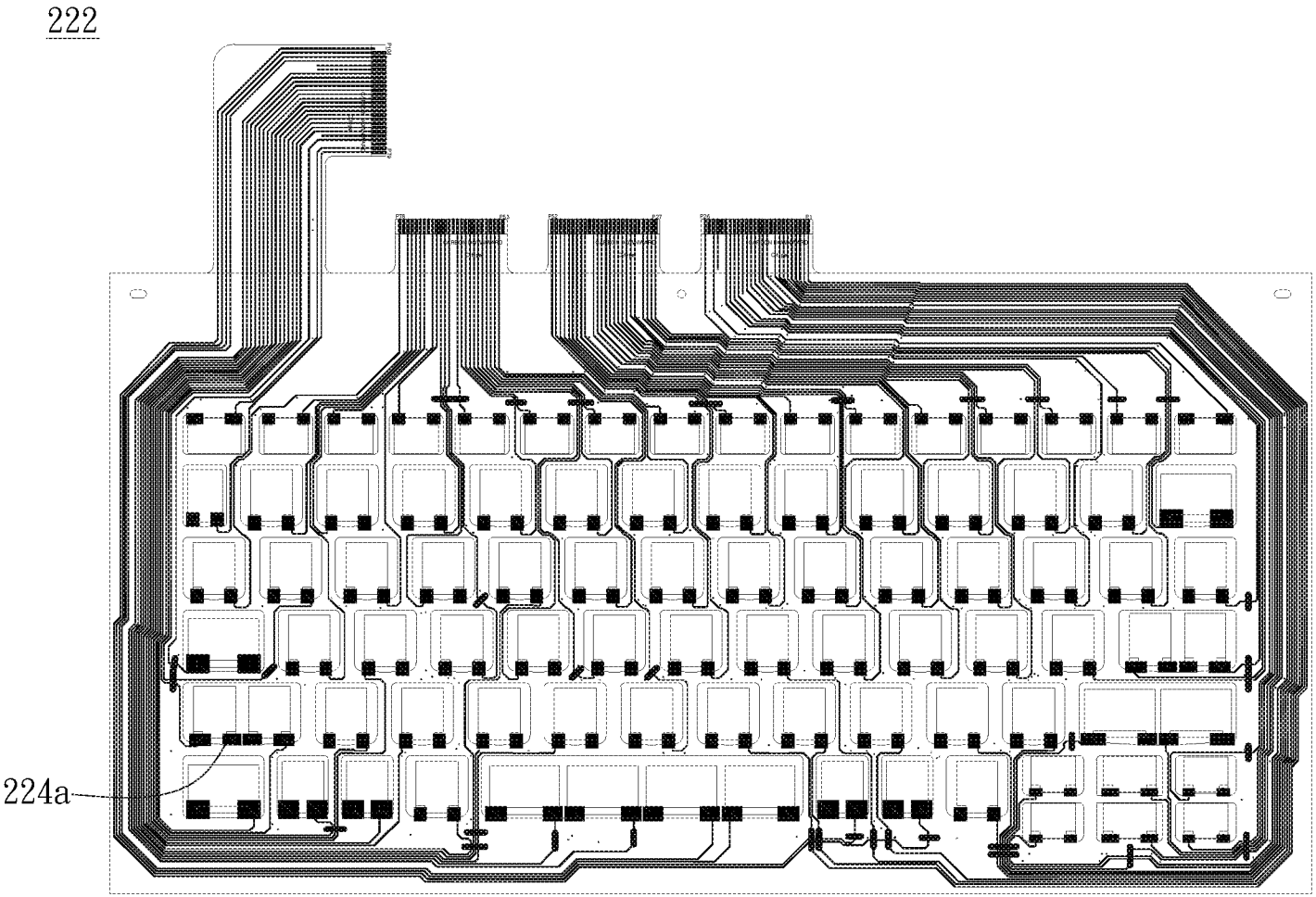
Figures 2, 4B:
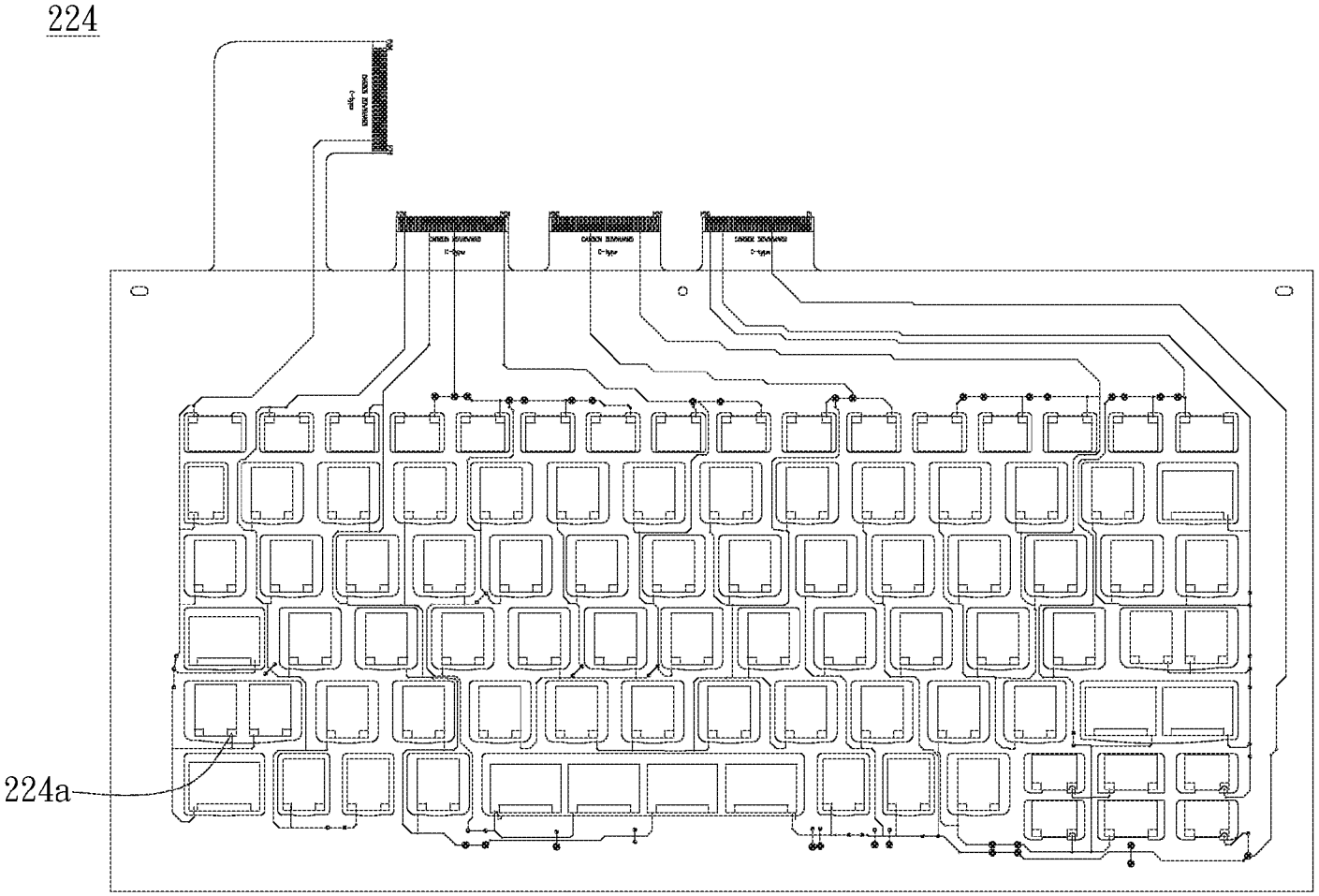

As shown in FIGS. 3A and 4B, the circuit layer 220 is disposed under the keycap layer 210. At least one of the first contacts 222*a* and at least one of the second contacts 224*a* correspond to each of the keycap regions 212 to electrically connect the haptic actuator 230. In other words, the plurality of haptic actuators 230 are disposed under the circuit layer 220. Each of the keycap regions 212 is corresponding to at least one of the haptic actuators 230, and each of the plurality of haptic actuators 230 is electrically connected to one of the first contacts 222*a* and one of the second contacts 224*a* corresponding to the same keycap region 212. It is noted that the haptic actuator 230 is similar to the haptic actuator 130, and the connection of the haptic actuator 230 to the circuit layer 220 can be referred to the related description of FIG. 1A. The circuit layer 220 includes a plurality of first circuit paths 222 and a plurality of second circuit paths 224 to provide the circuit paths to drive the haptic actuators 230, respectively. In an embodiment, as shown in FIG. 4B-1, the number of the first circuit paths 222 is the same as the number of the haptic actuators 230, and each of the first circuit paths 222 has one of the first contacts 222*a* for electrically connecting the corresponding haptic actuator 230. As shown in FIG. 4B-2, the number of the second circuit paths 224 is preferably less than the number of the haptic actuators 230, and at least one of the second circuit paths 224 has more than one of the second contacts 224*a*, so that the number of the second contacts 224*a* can be the same as the number of the haptic actuators 230 and the second contact 224*a* can electrically connect the corresponding haptic actuator 230. In this embodiment, the first circuit path 222 is a driving path for driving the haptic actuator 230, and the second circuit path 224 can be a common ground path for the plurality of haptic actuators 230. In other words, the ground paths of the plurality of haptic actuators 230 are preferably divided into groups and connected together, so that a single second circuit path 224 may have more than one second contact 224*a* and the total number of the second contacts 224 of all the second circuit paths 224 will be the same as the number of the haptic actuators 230. Therefore, the layout of the circuit paths can be simplified to reduce the necessary layout area and further reduce the size of the input device.

Figure 4C:
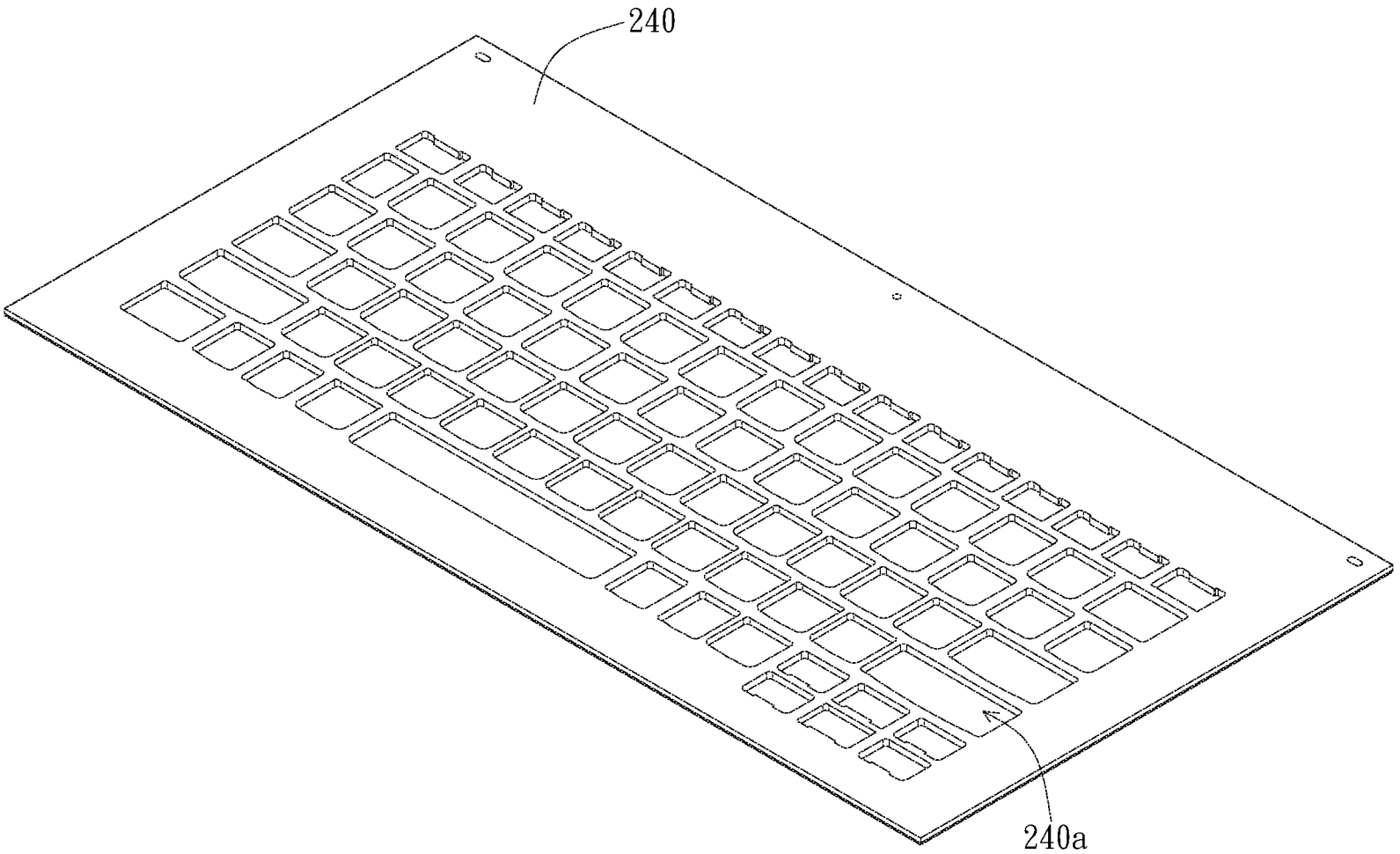
FIG. 4C is a schematic view of the support layer of FIG. 3A.

As shown in FIGS. 3A and 4C, the support layer 240 is disposed between the circuit layer 220 and the cushion layer 250. The support layer 240 has a plurality of openings 240*a* corresponding to the plurality of keycap regions 212, respectively. The plurality of protrusion portions 254 of the cushion layer 250 extend into the plurality of openings 240*a*, respectively. As described above, the hardness of the support layer 240 is preferably larger than the hardness of the cushion layer 250, and the thickness of the support layer 240 is preferably larger than the thickness of the haptic actuator 230 to provide sufficient vibration space for the haptic actuator 230.

Figure 4D:
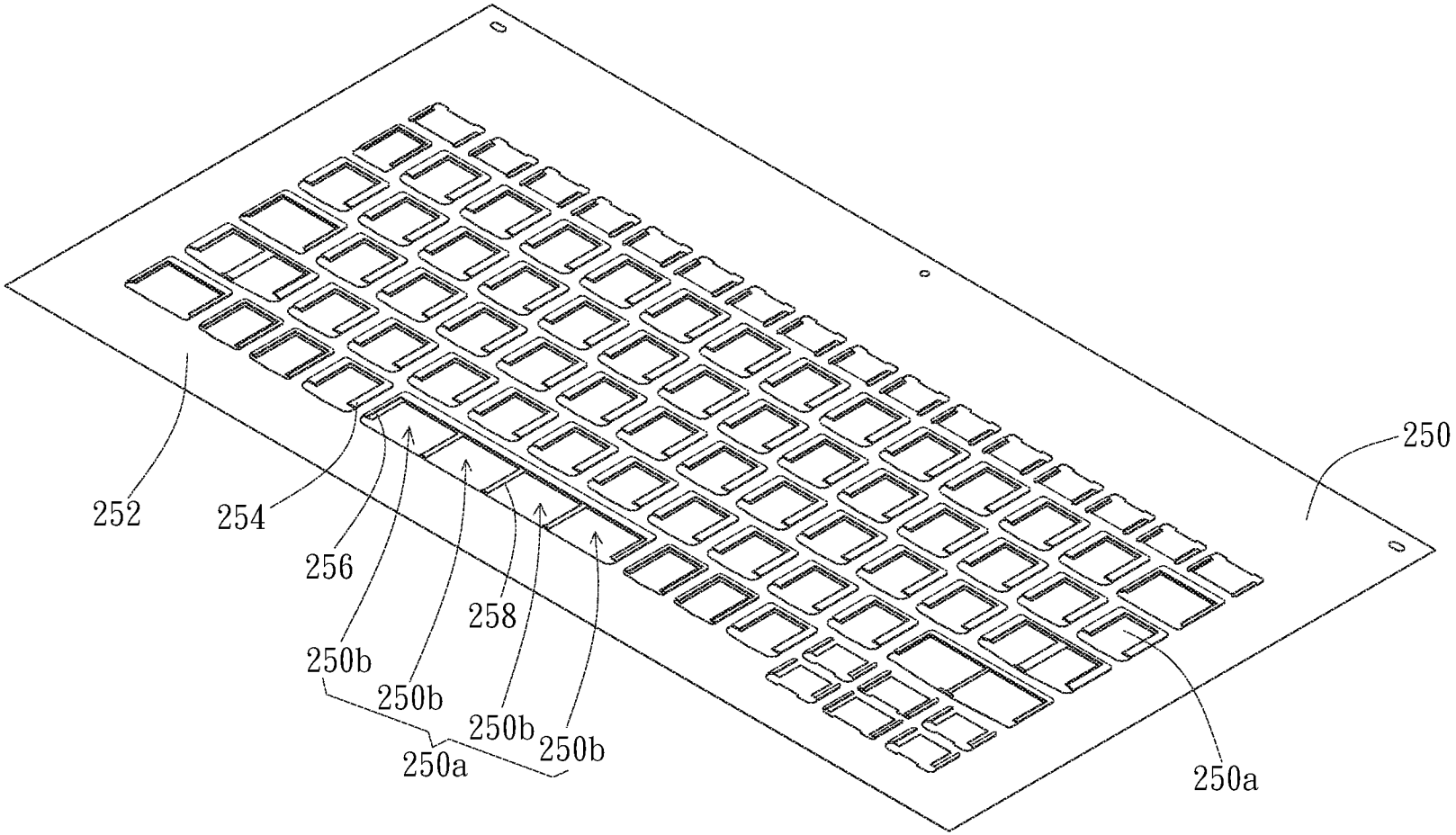
FIG. 4D is a schematic view of the cushion layer of FIG. 3A.

As shown in FIGS. 3A and 4D, the cushion layer 250 is disposed under the circuit layer 220. Corresponding to the keycap regions 212, the cushion layer 250 has a plurality of accommodation spaces 250*a* for accommodating the plurality of haptic actuators 230. The cushion layer 250 includes a film portion 252 and a plurality of protrusion portions 254. The plurality of protrusion portions 254 are connected together by means of the film portion 252 to form a single cushion layer. Similarly, the film portion 252 has a plurality of accommodation areas (e.g. through holes), and the plurality of protrusion portions 254 are correspondingly disposed around the accommodation areas. The protrusion portions 254 extend from the film portion 252 toward the circuit layer 220 to define the accommodation spaces 250*a* over the accommodation areas. When the support layer 240 is disposed on the film portion 252 of the cushion layer 250, the plurality of the protrusion portions 254 extend into the plurality of openings 240*a*, respectively. Moreover, the cushion layer 250 further has a plurality of extension portions 256. The plurality of extension portions 256 extend from the plurality of protrusion portions 254 toward the inner side of the accommodation space 250*a*, respectively. The top surface of the extension portion 256 is preferably lower than the top surface of the corresponding protrusion portion 254. Moreover, the extension portion 256 preferably extends under the lower surface of the corresponding haptic actuator 230, so that the haptic actuator 230 at least partially abuts on the top surface of the extension portion 256. It is noted that as shown in FIG. 4D, the plurality of protrusion portions 254 are connected together by the film portion 252, so that the plurality of protrusion portions 254 are indirectly connected to each other with a gap therebetween. Therefore, when the user presses one of the keyswitch structures, the pressing force is delivered downwardly through the corresponding protrusion portion 254 of the pressed keyswitch structure, and the pressing force is likely not to be transferred to adjacent protrusion portion 254 through the film portion 252 connected therebetween or the support layer 240 (if exists) to prevent the adjacent keyswitch structure from being inadvertently triggered.

Moreover, as shown in FIGS. 3A and 3B, the plurality of sensing units 262 can be integrated into a single sensor layer 260. The plurality of sensing units 262 can be controlled by a single control circuit 270 to simplify the manufacturing and assembly processes, but not limited thereto.

The operation is similar to that of FIG. 1D or 2D. For example, when an external force is applied to one of the keycap regions 212 and delivered downwardly through the force-transferring portion of the corresponding cushion layer 250 (e.g. the protrusion portion 254 and/or the extension portion 256) by at least one of the above two paths to trigger the corresponding one of the sensing units 262. The triggered sensing unit 262 outputs the trigger signal T to the control circuit 270. The trigger signal T not only serves as a sensing signal for inputting the corresponding character or command of the keyswitch structure, but also as an indicating signal for generating the driving signal D, so that the control circuit 270 can output the driving signal D to the corresponding haptic actuator 230 upon receiving the trigger signal T. When the haptic actuator 230 receives the driving signal D from the control circuit 270 through the circuit paths of the circuit layer 220, such as the first circuit path 222 and the second circuit path 224, the haptic actuator 230 vibrates within the accommodation space 250*a* to provide the vibration feedback of confirming the key-pressing operation.

It is noted that as the keyswitch structure has a larger size (e.g. the larger-sized key including SPACE key, ENTER key, CAPS LOCK key, SHIFT key, CTRL key, ALT key in the computer keyboard), the cushion layer may have a larger accommodation space and additional structures to accommodate different amount of haptic actuators, so that the haptic feedback can be provided no matter the user presses which location of the keycap region. That is, the computer keyboard generally includes a plurality of regular-sized keys and a plurality of larger-sized keys; the keycap regions 212 of the keycap layer 110 correspondingly include a plurality of regular-sized keycap regions and a plurality of larger-sized keycap regions, and the cushion layer 250 accordingly has a plurality of regular-sized and larger-sized accommodation spaces to accommodate one or more than one of the haptic actuators 230. For example, when a single keyswitch structure has a plurality of haptic actuators 230, the circuit layer 220 has a plurality of first contacts 222*a* and a plurality of second contacts 224*a* to connect the plurality of haptic actuators 230, respectively. As shown in FIG. 4B, corresponding to the location of the SPACE key 200', the circuit layer 220 may have four first contacts 222*a* and four second contacts 224*a* to connect four haptic actuators 230, respectively.

Figure 5:
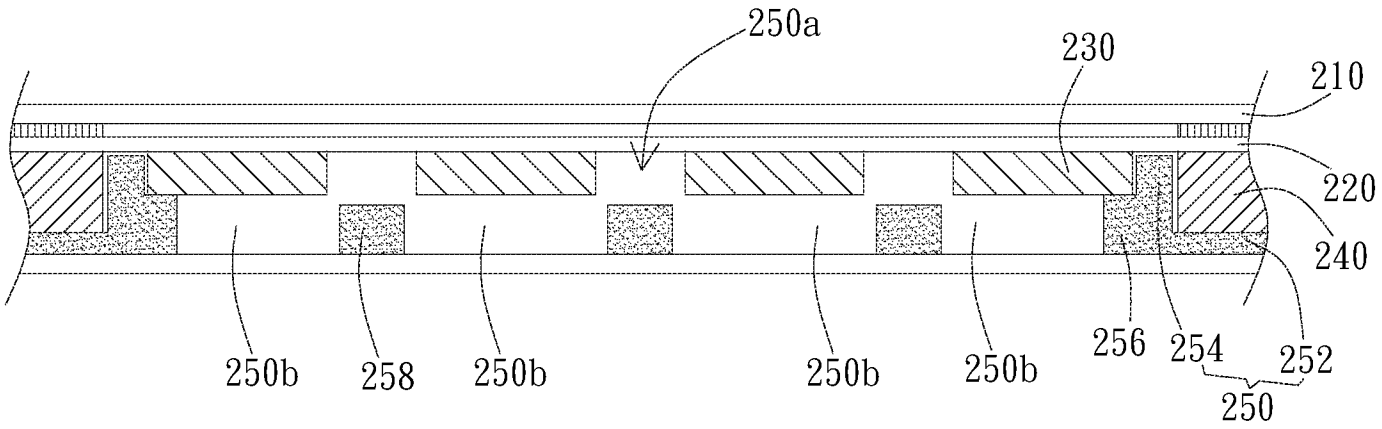
FIG. 5 is a partial cross-sectional view of the keyswitch structure according to another embodiment of the invention.

Correspondingly, in an embodiment, as shown in FIGS. 4A and 5, the film portion 250 further has at least one rib 258. The rib 258 is disposed in the corresponding accommodation area 250*a* which is embodied as a through hole. The rib 258 has a top surface lower than the top surface of the protrusion portion 254 to divide the corresponding accommodation space 250*a* into a plurality of sub-spaces 250*b* for accommodating the haptic actuators 230, respectively. In particular, the plurality of ribs 258 are preferably disposed parallel to each other and traverse the accommodation space 250*a* from two opposite sides of the through hole, so that the lower portion of the accommodation space 250*a* is divided into a plurality of sub-spaces 250*b* to serve as the vibration spaces for corresponding haptic actuators 230. In other words, for a larger-sized key, the accommodation space 250*a* is divided into a plurality of sub-spaces 250*b*, such as four sub-spaces, and each of the four sub-spaces 250*b* accommodates one corresponding haptic actuator 230 to achieve the configuration of a single keyswitch structure with multiple haptic actuators 230. In an embodiment, the thickness of the rib 258 is larger than or equal to the thickness of the haptic actuator 230. When the user presses the keycap region 212, especially presses the portion of the keycap region 212 that is away from the support layer 240 or the protrusion portion 254 (e.g. the middle portion), appropriate vibration space for haptic actuators 230 can be ensured. In addition, in this embodiment, the sensing circuit of the sensing unit 262 preferably further corresponds to the arrangement of the ribs 258, so that in addition to the above two paths, the cushion layer 250 can transfer the pressing force through a third path, (3) through the rib 258 to the sensing unit 262.

Figure 6:
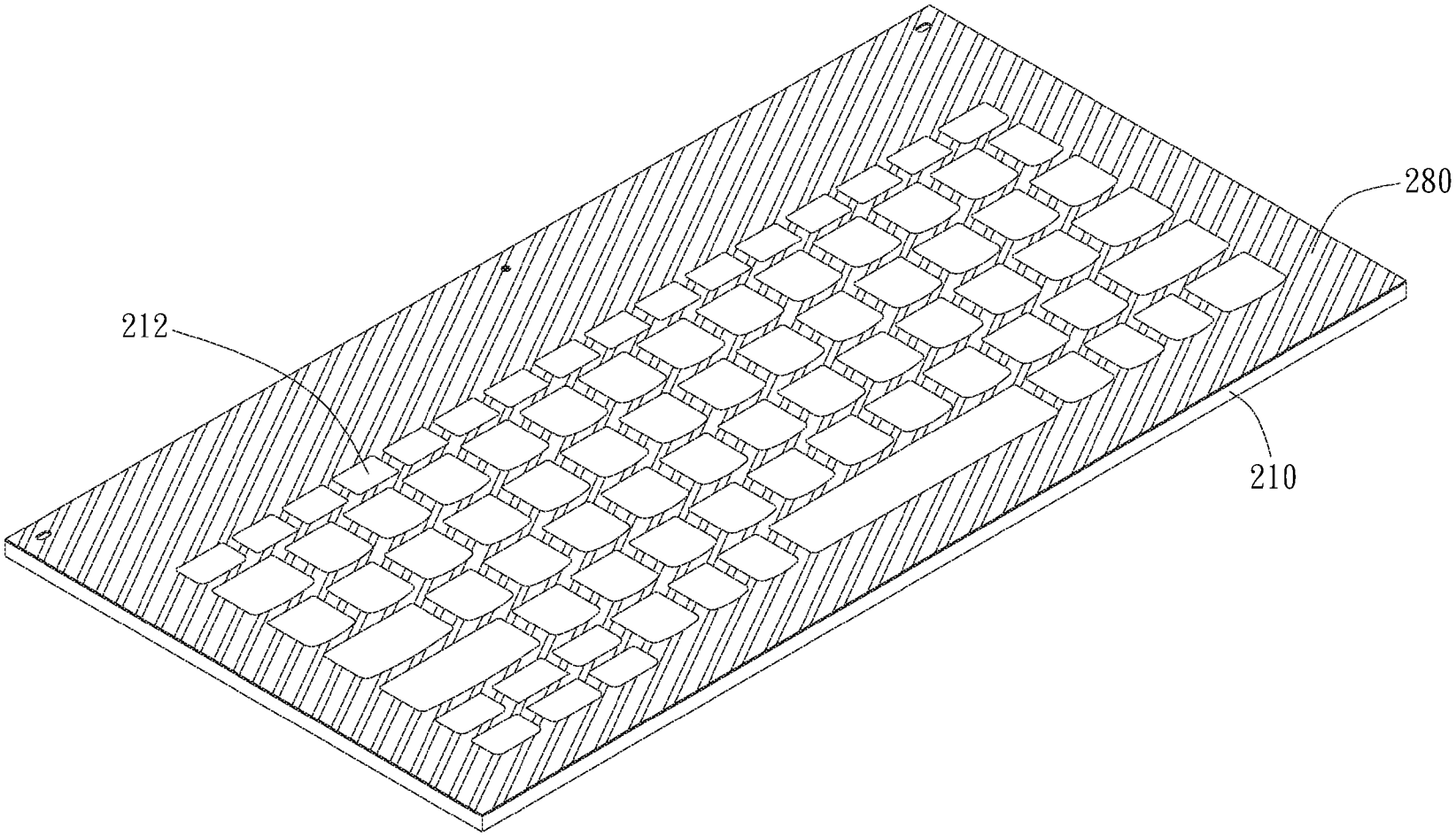
FIG. 6 is a schematic view showing the arrangement of the keycap layer and the adhesive layer of the input device.

Moreover, as shown in FIG. 6, the input device includes an adhesive layer 280. The adhesive layer 280 is disposed on a bottom surface of the keycap layer 210 outside the keycap regions 212. The bottom surface of the peripheral region 214 of the keycap layer 210 is adhered to the circuit layer 220 by the adhesive layer 280, and the bottom surface of the keycap regions 212 is separated from the circuit layer 220. Similarly, the adhesive layer 280 is disposed only on a portion of the bottom surface of the keycap layer 210 that corresponds to the peripheral region 214. That is, the bottom surface of the keycap regions 212 is not disposed with the adhesive layer 280, so that the keycap regions 212 and the portion of the circuit layer 220 that corresponds to the keycap regions 212 are not physically adhered together, i.e. the keycap regions 212 and the portion of the circuit layer 220 that corresponds to the keycap regions 212 have a gap therebetween. As such, when the haptic actuator 230 is driven to vibrate by the driving signal, the kinetic energy loss of the haptic actuator 230 occurring during vibration can be reduced. That is, if the entire keycap layer 210 is adhered to the circuit layer 220, the "load" of the haptic actuator 230 is increased and the vibration of the haptic actuator 230 becomes more difficult, resulting in the increase in kinetic energy loss. Moreover, the remaining components of the input device 10, such as the circuit layer 220, the cushion layer 250, and the sensor layer 260, can be connected by adhesives to fix the relative positions among the components.

Compared to prior arts, the input device and the keyswitch structure of the invention have a thin laminated characteristic by stacking component layers and provide the haptic feedback by the haptic actuator for confirming the key-pressing operation. Moreover, the input device and the keyswitch structure of the invention utilize the circuit layer as the substrate layer and the circuit path layer for carrying and electrically connecting the haptic actuator and the cushion layer as the force-transferring layer and the supporting structure layer to simplify the assembly process and increase the manufacturability. In addition, the input device and the keyswitch structure of the invention utilize the cushion layer as the force-transferring layer and the support layer as the supporting structure layer, not only ensuring appropriate vibration space for the haptic actuator, but also reducing the possibility of generating false trigger signal by the sensing unit. The input device of the invention utilizes the protrusion portion of the cushion layer as the force—transferring portion, so that the pressing force is not easily transferred to adjacent protrusion portion to prevent the adjacent keyswitch structure from inadvertently generating the false trigger signal. Furthermore, the input device and the keyswitch structure of the invention utilize the disposition of ribs to ensure appropriate vibration spaces, so that the haptic actuators effectively provide vibration feedback no matter where the pressing force is applied.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A keyswitch structure, comprising:

a keycap layer having a keycap region;

a circuit layer disposed under the keycap layer, the circuit layer having at least one first contact and at least one second contact on a bottom surface of the circuit layer, the first contact being electrically isolated from the second contact;

at least one haptic actuator disposed under the circuit layer and electrically connected to the first contact and the second contact;

a cushion layer disposed under the circuit layer, the cushion layer having an accommodation space for accommodating the haptic actuator, the cushion layer comprising a film portion having an accommodation area and a protrusion portion disposed around the accommodation area, the protrusion portion extending beyond an upper surface of the film portion toward the circuit layer to define the accommodation space over the accommodation area;

a sensing unit disposed under the cushion layer, the sensing unit outputting a trigger signal whenever the sensing unit is triggered; and a control circuit coupling the sensing unit and the circuit layer, the control circuit outputting a driving signal to the haptic actuator whenever the control circuit receives the trigger signal, wherein when an external force is applied and delivered downwardly through the cushion layer to trigger the sensing unit, the sensing unit outputs the trigger signal and the control circuit outputs the driving signal to drive the haptic actuator.

2. The keyswitch structure of claim 1, wherein the cushion layer further has an extension portion extending from the protrusion portion toward the accommodation space; the extension portion has a top surface lower than the top surface of the protrusion portion; the haptic actuator at least partially abuts on the top surface of the extension portion.

3. The keyswitch structure of claim 1, wherein the circuit layer further has a first circuit path and a second circuit path; the protrusion portion has a U-shaped configuration with an opening; the first circuit path and the second circuit path are electrically connected to the first contact and the second contact through the opening of the U-shaped configuration, respectively.

4. The keyswitch structure of claim 1, further comprising an adhesive layer disposed on a bottom surface of the keycap layer outside the keycap region; the keycap layer is adhered to the circuit layer by the adhesive layer, and the bottom surface of the keycap region is separated from the circuit layer.

5. The keyswitch structure of claim 1, wherein the accommodation area is a through hole communicating with the accommodation space; the protrusion portion is disposed around the through hole.

6. The keyswitch structure of claim 5, wherein the film portion further has at least one rib disposed in the through hole; the rib has a top surface lower than the top surface of the protrusion portion to divide the accommodation space into a plurality of sub-spaces.

7. The keyswitch structure of claim 6, wherein the at least one haptic actuator includes a plurality of haptic actuators corresponding to the plurality of sub-spaces, respectively; the at least one first contact and the at least one second contact include a plurality of first contacts and a plurality of second contacts corresponding to the plurality of haptic actuators.

8. The keyswitch structure of claim 6, wherein the thickness of the rib is larger than or equal to the thickness of the haptic actuator.

9. The keyswitch structure of claim 1, further comprising a support layer disposed between the circuit layer and the sensing unit, wherein the support layer has an opening, the protrusion portion protrudes into the opening; when the external force is applied to the keycap region, the external force is delivered downwardly through the protrusion portion to trigger the sensing unit.

10. The keyswitch structure of claim 9, wherein the opening of the support layer has a first top-view contour; the accommodation space of the cushion layer has a second top-view contour; the haptic actuator has a third top-view contour; all of the first, second, and third top-view contours have same shape.

11. The keyswitch structure of claim 9, wherein the hardness of the support layer is higher than the hardness of the cushion layer; the thickness of the support layer is larger than the thickness of the haptic actuator, so that the circuit layer and the sensing unit maintain a predetermined distance separated from each other to provide a vibration space for the haptic actuator.

12. The keyswitch structure of claim 11, wherein the predetermined distance makes the haptic actuator be separated from the sensing unit by at least 0.8 mm.

13. An input device, comprising:

a keycap layer having a plurality of keycap regions;

a circuit layer disposed under the keycap layer, the circuit layer having a plurality of first contacts and a plurality of second contacts on a bottom surface of the circuit layer, the first contacts being electrically isolated from the second contacts, each of the keycap regions being corresponding to at least one of the first contacts and at least one of the second contacts;

a plurality of haptic actuators disposed under the circuit layer, each of the keycap regions being corresponding to at least one of the haptic actuators, and each of the plurality of haptic actuators electrically connected to one of the first contacts and one of the second contacts corresponding to the same keycap region;

a cushion layer disposed under the circuit layer, the cushion layer having a plurality of accommodation spaces, each of the plurality of keycap regions being corresponding to at least one of the accommodation spaces, each of the accommodation spaces accommodating at least one of the plurality of haptic actuators, the cushion layer comprising a film portion having a plurality of accommodation areas and a plurality of protrusion portions correspondingly disposed around the accommodation areas, the protrusion portions extending beyond an upper surface of the film portion toward the circuit layer to define the accommodation spaces over the accommodation areas;

a sensor layer disposed under the cushion layer, the sensor layer comprising a plurality of sensing units, each of the plurality of keycap regions being corresponding to at least one of the sensing units, each of the sensing units capable of being triggered to output a trigger signal; and a control circuit coupling the plurality of sensing units and the circuit layer, the control circuit outputting a driving signal to a corresponding one of the haptic actuators whenever the control circuit receiving the trigger signal from the corresponding sensing unit, wherein when an external force is applied to one of the keycap regions and delivered downwardly through the cushion layer to trigger one of the sensing units, the triggered sensing unit outputs the trigger signal and the control circuit outputs the driving signal to drive one of the haptic actuators corresponding to the triggered sensing unit.

14. The input device of claim 13, wherein the plurality of keycap regions includes a larger-sized keycap region and a regular-sized keycap region smaller than the larger-sized keycap region; a first accommodation space of the accommodation spaces corresponds to the larger-sized keycap region and accommodates at least two of the haptic actuators; the film portion corresponding to the larger-sized keycap region further has at least one rib disposed in the corresponding accommodation area; the rib has a top surface lower than the top surface of the protrusion portion to divide the first accommodation space into a plurality of sub-spaces for accommodating the at least two haptic actuators, respectively.

15. The input device of claim 13, wherein the circuit layer comprises a plurality of first circuit paths and a plurality of second circuit paths; the number of the first circuit paths is the same as the number of the haptic actuators; each of the first circuit paths has one of the first contacts.

16. The input device of claim 15, wherein the number of the second circuit paths is less than the number of the haptic actuators; at least one of the second circuit paths has more than one of the second contacts, so that the number of the second contacts can be the same as the number of the haptic actuators.

* * * * *